US005696534A

United States Patent [19]

Lavelle et al.

[11] Patent Number: 5,696,534

[45] Date of Patent: Dec. 9, 1997

[54] TIME MULTIPLEXING PIXEL FRAME BUFFER VIDEO OUTPUT

[75] Inventors: Michael G. Lavelle, Saratoga; Alex N. Koltzoff, Sausalito; David C. Kehlet, Sunnyvale, all of Calif.

[73] Assignee: Sun Microsystems Inc., Mountain View, Calif.

[21] Appl. No.: 408,272

[22] Filed: Mar. 21, 1995

[51] Int. Cl.[6] ..... G09G 5/04

[52] U.S. Cl. ..... 345/154; 345/185; 345/199

[58] Field of Search ..... 345/185–203, 345/133, 154; 395/164, 166, 197, 162, 526, 484, 501–510

[56] References Cited

U.S. PATENT DOCUMENTS

| | | | |
|---|---|---|---|
| 4,704,605 | 11/1987 | Edelson . | |
| 4,769,632 | 9/1988 | Work et al. . | |
| 4,827,255 | 5/1989 | Ishii . | |
| 4,894,653 | 1/1990 | Frankenbach . | |
| 5,230,064 | 7/1993 | Kuo et al. | 395/162 |
| 5,251,298 | 10/1993 | Nally | 395/166 |
| 5,289,565 | 2/1994 | Smith et al. | 395/131 |
| 5,436,641 | 7/1995 | Hoang et al. . | |
| 5,440,682 | 8/1995 | Deering | 395/162 |
| 5,510,843 | 4/1996 | Keene et al. | 348/446 |
| 5,544,306 | 8/1996 | Deering et al. | 395/164 |

FOREIGN PATENT DOCUMENTS

WO-A-89
12885 12/1989 WIPO .

*Primary Examiner*—Richard Hjerfe
*Assistant Examiner*—David L. Lewis
*Attorney, Agent, or Firm*—Blakely Sokoloff Taylor & Zafman

[57] ABSTRACT

A method and for multiplexing pixel data from a frame buffer to a RAMDAC to reduce the number of pins required. For many graphics operations optimal performance is achieved by storing an entire 32-bit pixel in a single RAM chip. When displaying video data from a frame buffer, pixels must be read out serially from the frame buffer at real-time speeds. A frame buffer memory with 16 pins for serial video output is used. An entire 32-bit pixel is stored in a single RAM chip. For a 32-bit pixel containing four byte (8-bit) quantities designated X, B, G and R, on the first clock cycle, the X and B bytes are made available on the 16 pins of the frame buffer. On the next clock cycle, the G and R bytes are made available. Thus, over two cycles the entire 32-bit pixel is output from the frame buffer to a RAMDAC which samples the X and B bytes on 16 input pins. The RAMDAC stores these X and B bytes in an internal register. On the next clock cycle it samples the G and R bytes. The DAC then reassembles the X, B, G and R bytes into a single 32-bit pixel for conversion into video. In this manner, 32-bit pixels are communicated across a 16-bit pixel data bus.

20 Claims, 21 Drawing Sheets

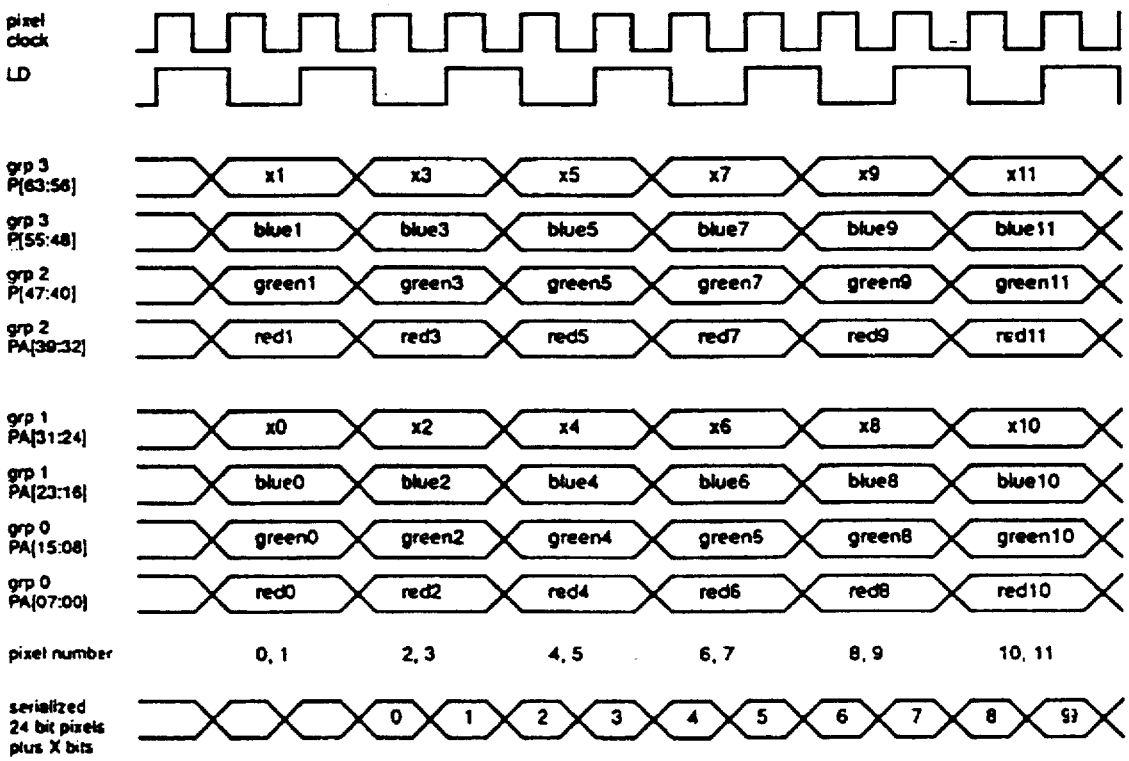
FIG. 4 2:1 Single Buffered Interleaved Pixel Format

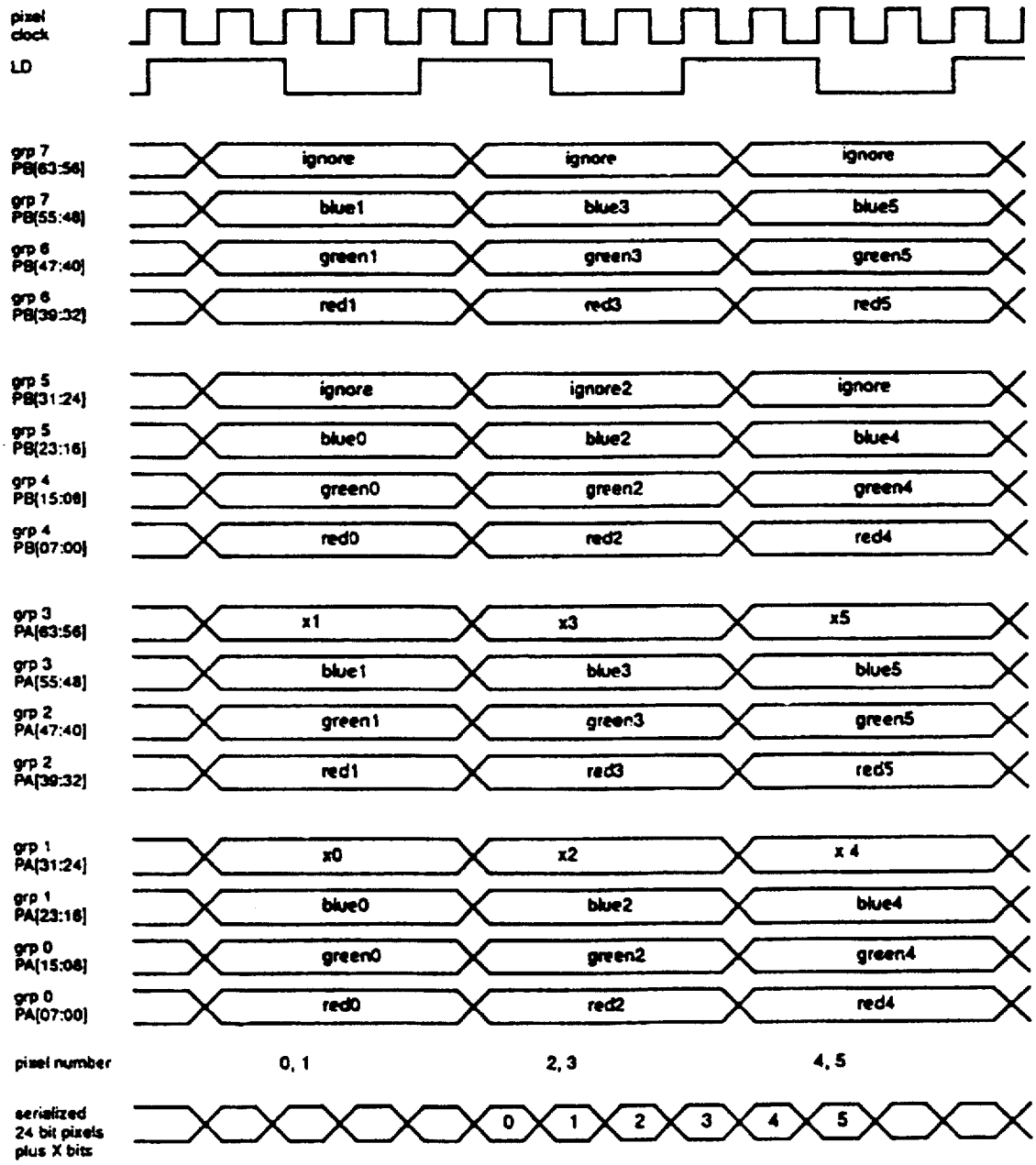
FIG. 5 2:1Double Buffered Interleaved Pixel Format

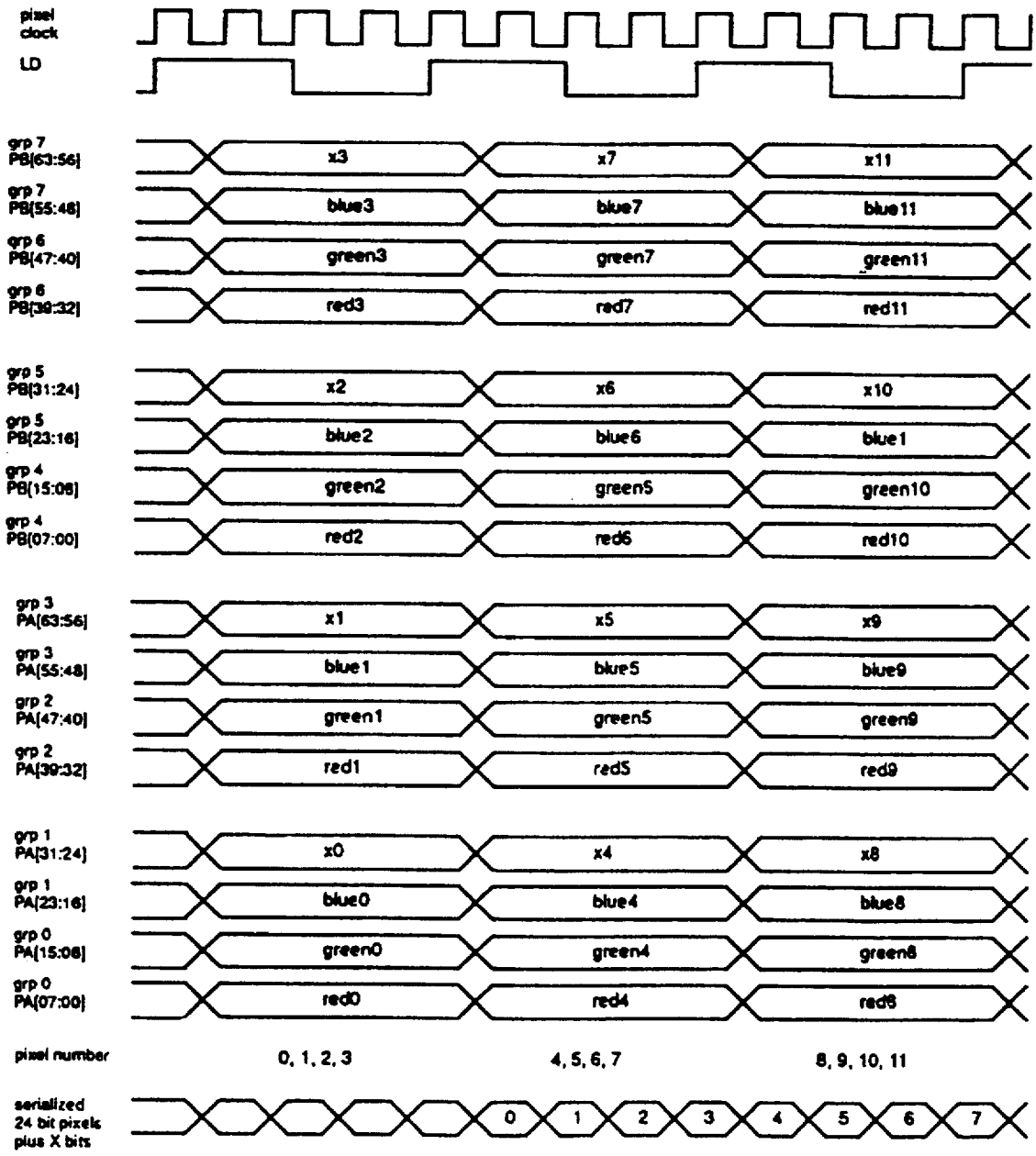
FIG. 6 4:1 Single Buffered Interleaved Pixel Format

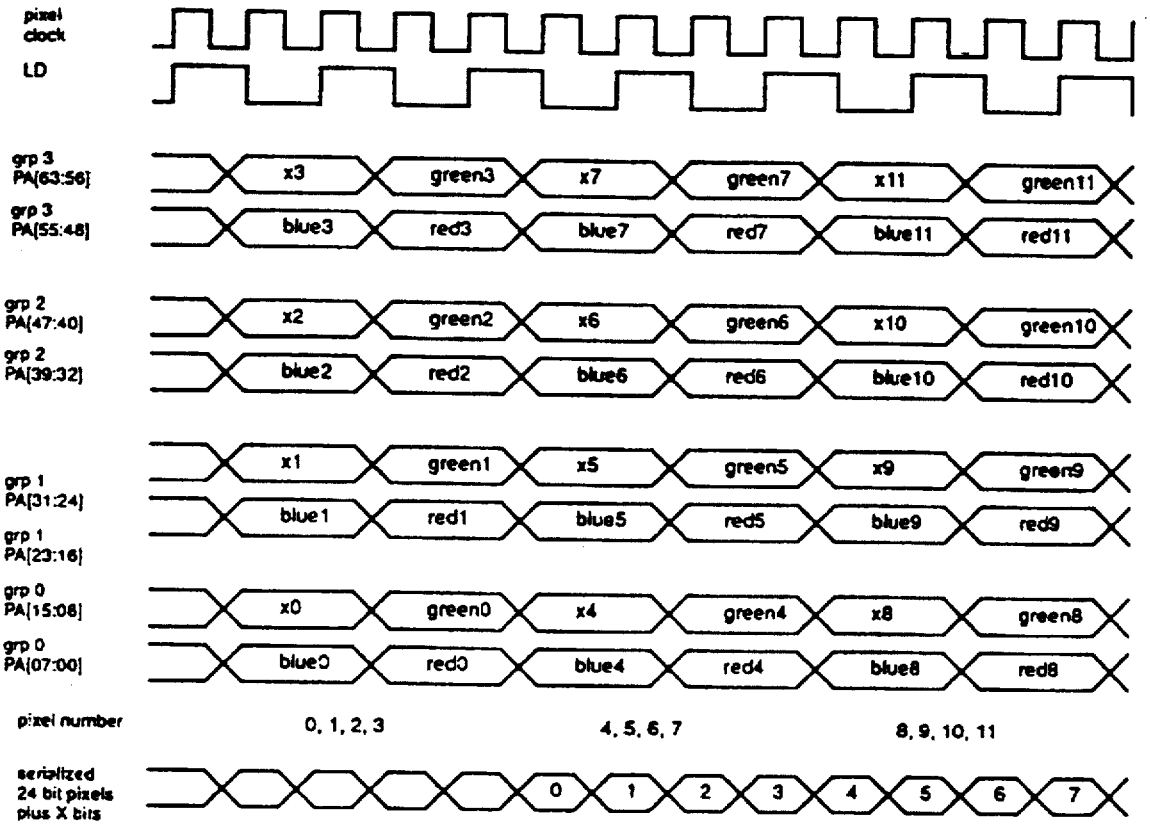
FIG. 7 $^{4}/_{2}$:1 Single Buffered Interleaved Pixel Format

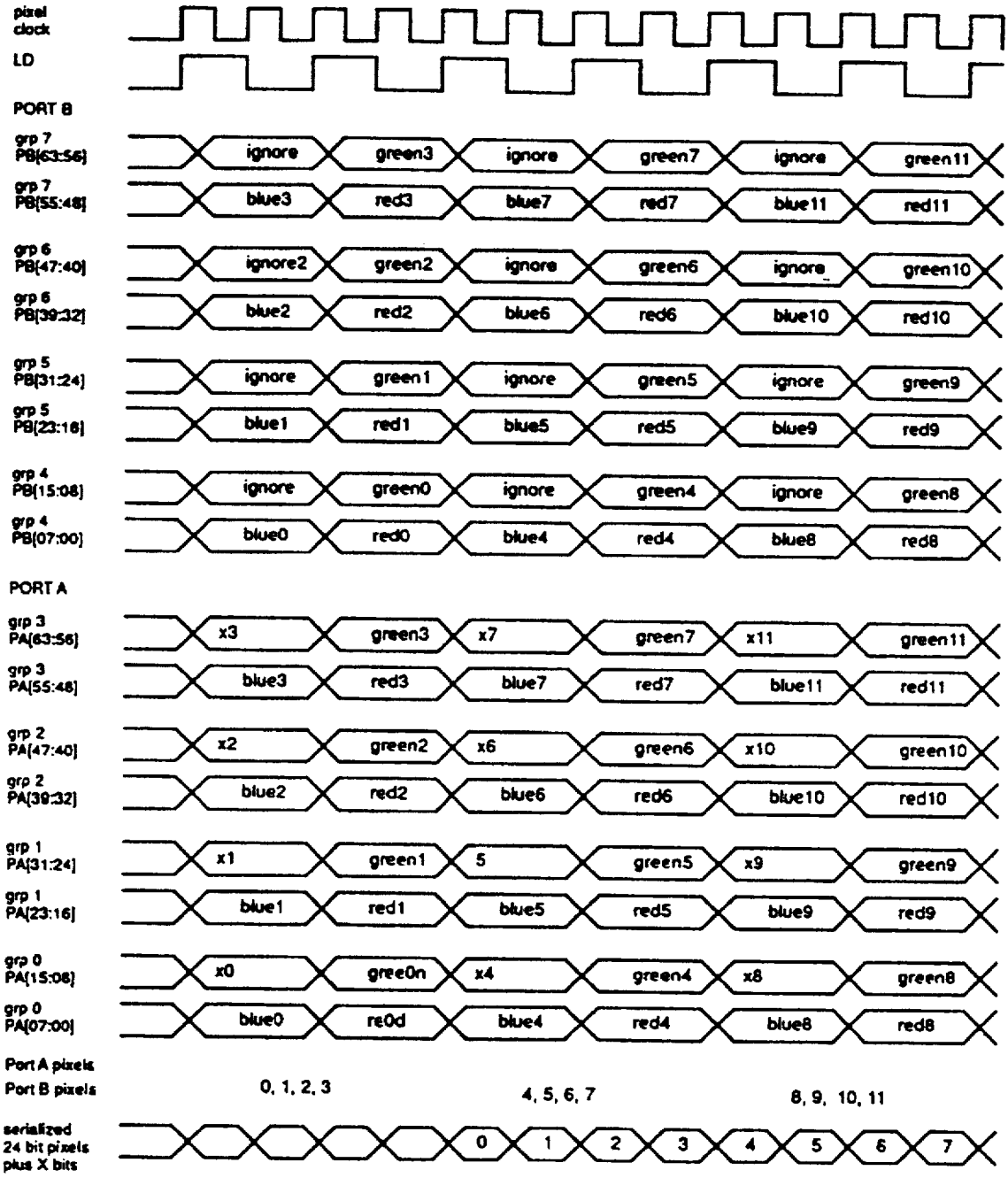
FIG. 8 4/2:1 Double Buffered Interleaved Pixel Format

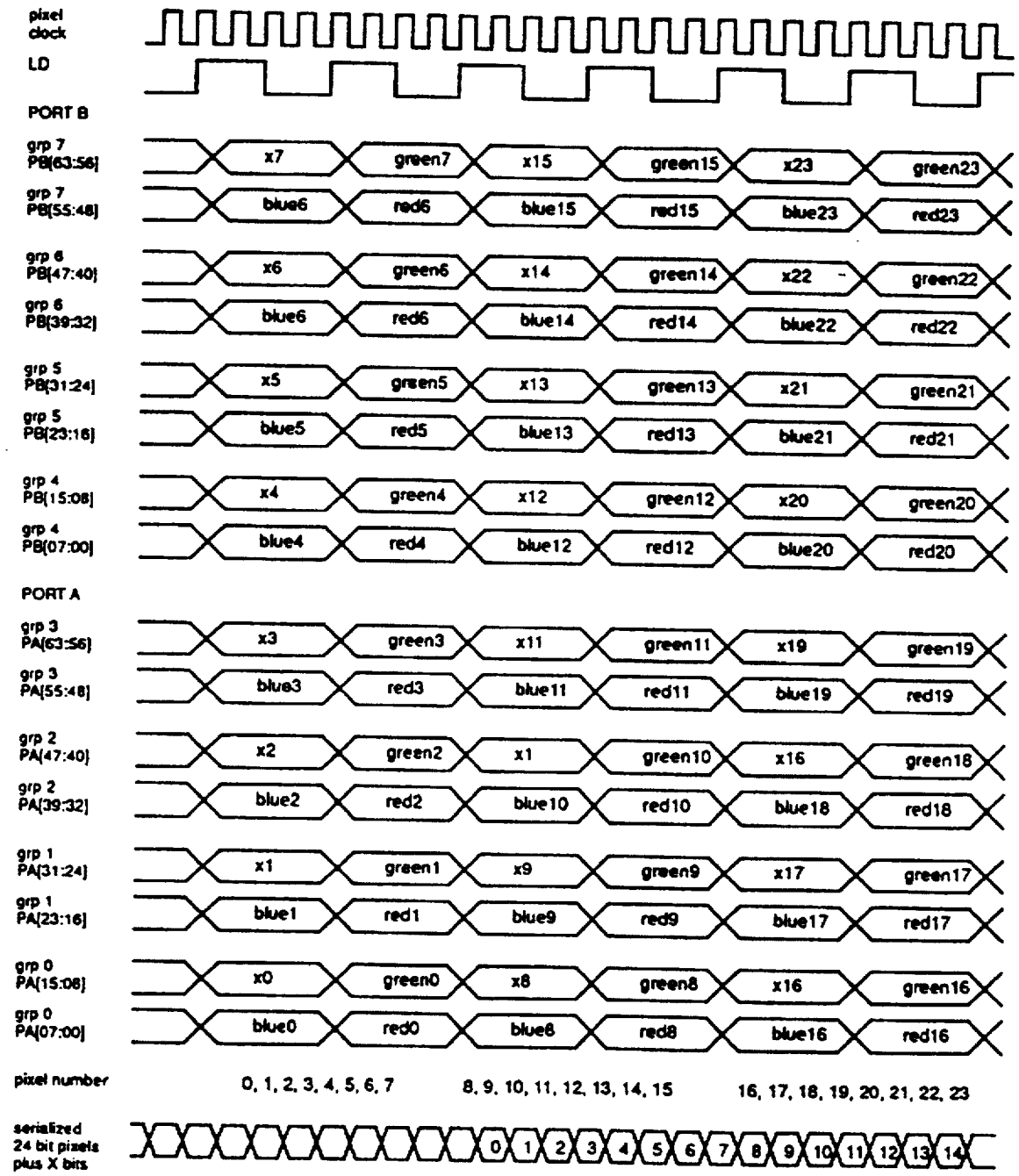
FIG. 9 $^{8}/_{2}$:1 Single Buffered Interleaved Pixel Format

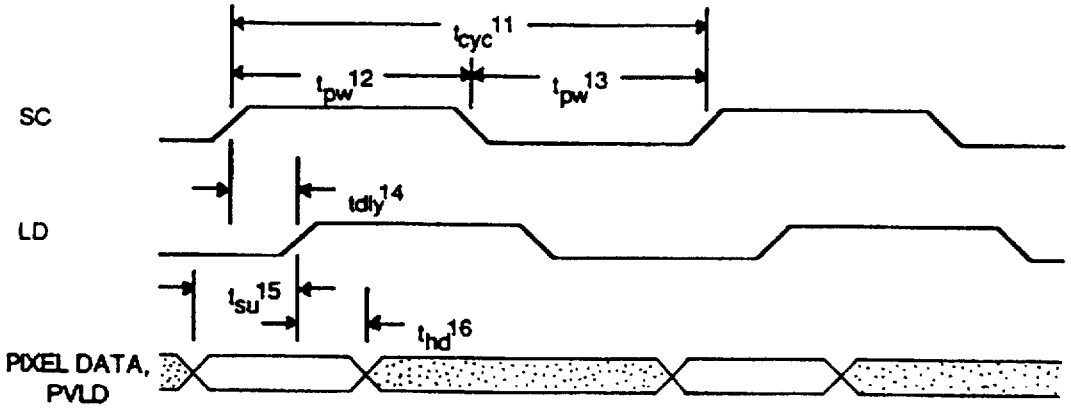
FIG. 10 PIXEL PORT TIMING
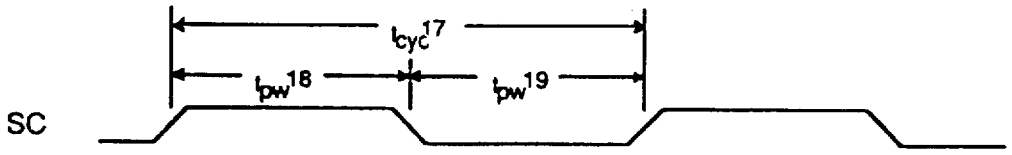
FIG. 11 PIXEL CLOCK INPUT (PLL BYPASSED)
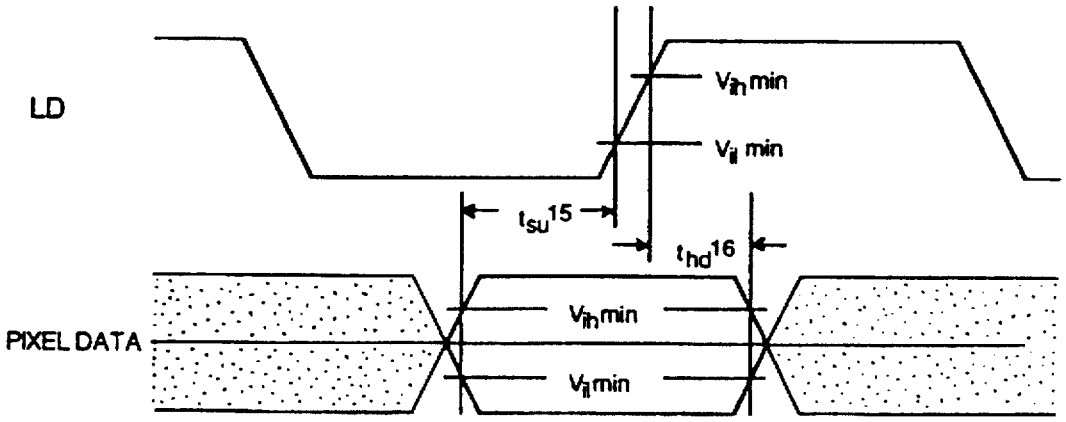
FIG. 12 PIXEL PORT TIMING - DETAIL

| OUTPUT PIXEL | 2:1 SINGLE BUFFERED | 2:1 DOUBLE BUFFERED | 4:1 SINGLE BUFFERED | 4/2:1 DOUBLE BUFFERED | 4/2:1 SINGLE BUFFERED | 8/2:1 SINGLE BUFFERED |
|---|---|---|---|---|---|---|
| P7 | | | | | | GRP 7 |
| | | | | | | |
| P6 | | | | | | GRP 6 |
| | | | | | | |
| P5 | | | | | | GRP 5 |
| | | | | | | |
| P4 | | | | | | GRP 4 |
| | | | | | | |
| P3 BUFFER B | | | | GRP 7 | | |
| P3 BUFFER A | | | GRP 7 AND 6 | GRP 3 | GRP 3 | GRP 3 |
| | | | | | | |
| P2 BUFFER B | | | | GRP 6 | | |
| P2 BUFFER B | | | GRP 5 AND 4 | GRP 2 | GRP 2 | GRP 2 |
| | | | | | | |
| P1 BUFFER B | | GRP 7 AND 6 | | GRP 5 | | |
| P1 BUFFER B | GRP 3 AND 2 | GRP 3 AND 2 | GRP 3 AND 2 | GRP 1 | GRP 1 | GRP 1 |
| | | | | | | |
| P0 BUFFER B | | GRP 5 AND 4 | | GRP 4 | | |
| P0 BUFFER B | GRP 1 AND 0 | GRP 1 AND 0 | GRP 1 AND 0 | GRP 0 | GRP 0 | GRP 0 |

FIG. 23

TIME MULTIPLEXING PIXEL FRAME BUFFER VIDEO OUTPUT

BACKGROUND OF THE INVENTION

1. Field of the Invention

This invention relates to computer systems and, more particularly, to a RAMDAC (random access memory-digital-to-analog converter) used to transfer and process data from a frame buffer to an output display device.

2. History of the Prior Art

One of the significant problems involved in increasing the operational speed of desktop computers has been in finding ways to increase the rate at which information is transferred to an output display device. Many of the various forms of data presentation which are presently available require that large amounts of data be transferred. For example, if a computer output display monitor is operating in a color mode in which 1280×1024 pixels are displayed on the screen at once and the mode is one in which thirty-two bits are used to define each pixel, then a total of over forty million bits of information must be transferred to the screen with each individual picture (called a "frame") that is displayed. Typically, sixty frames are displayed each second so that over one and one-half billion bits must be transferred each second in such a system. This requires a very substantial amount of processing power.

In order to provide such a large amount of information to an output display device, computer systems typically utilize a frame buffer which holds the pixel data which is to be displayed on the output display.

Typically a frame buffer offers a sufficient amount of random access memory to store one frame of data to be displayed. The information in the frame buffer is transferred to the display from the frame buffer sixty or more times each second. After (or during) each transfer, the pixel data in the frame buffer is updated with the new information to be displayed in the next frame.

Various improvements have been made to speed access in frame buffers. In DRAM frame buffers, pixel data may be read from the same port as data is written. This approach severely reduces the time available for rendering graphics data to the frame buffer. VRAM frame buffers add a separate video data port so that the main pixel port remains free for rendering. Two-ported video random access memory (VRAM) or frame buffer random access memory (FBRAM) has been substituted for dynamic random access memory so that information may be transferred from the frame buffer to the display at the same time other information is being loaded into the frame buffer.

One of the problems which all frame buffers have faced is caused by the method by which data is transferred from the frame buffer to an output display device. Typically, the display device is a cathode ray tube which renders the pixel data stored in the frame buffer on a screen in a series of rows. A typical display is comprised of 1024 horizontal rows, each of which includes as many as 1280 individual pixels. A frame is described on the display by writing individual rows of pixels starting at the upper left corner of the display. Each row of pixels is rendered from left to right across the display before a next row in sequence is begun. When a row is completed, the next row below is begun at the left side of the screen. Each row is rendered in order until the last row at the bottom of the screen is completed. This completes one frame. Then the process starts over from the beginning with the next frame at the upper left corner of the display. As explained above, in the typical display sixty individual frames are presented each second.

In order to cause each of the pixels stored in the frame buffer to be presented at the appropriate position on the display, it is necessary to read the data for each pixel and transfer that data to the circuitry which controls its rendering on the output display device.

Frame buffers exist today that time multiplex the pixel data output of a RAM in order to pack 24-bit pixels onto a 32-bit data bus. This invention differs from such prior art approaches in that full 32-bit pixels are used, and the purpose is to allow a whole 32-bit pixel to live in a single RAM chip.

VRAMs of Samsung (Samsung WRAM) select 16 pins per RAM for their video port. However, this approach does not suggest that a whole 32-bit pixel be stored in the frame buffer, nor does it suggest that a 32-bit pixel be time multiplexed to get the pixel out of the frame buffer.

The data from the frame buffer is input to circuitry which converts the data from the frame buffer to a form usable by the output display device. FIGS. 1 and 2 each show a computer system in which the present invention may be utilized where data in a memory 11 from a host CPU 12 is placed on host bus 13 and passed by rendering controller 14 to the frame buffer memory shown in FIGS. 1 and 2 as VRAMs 15*a*–15*d*, although FBRAMs could be used as well. A RAMDAC 21 is coupled to the host bus through the rendering controller and to the frame buffer and includes a look-up table (or LUT which is the RAM part of the RAMDAC) and other elements for translating 16 bit data from VRAMs 15*a*–15*d* to a 64 or 128 bit digital RGB signal which is converted by a digital to analog converter (DAC) to three analog signals representing voltage levels for red, blue and green which when combined at a pixel location in monitor 25 create a desired color at that pixel. The particulars of the frame buffer, rendering controller and monitor components are well known in the art and will not be described herein except as necessary for a proper understanding of the invention. In this connection, for the most part, the present invention is directed to certain improvements to RAMDAC 21 which provide the enhanced capabilities of the invention.

SUMMARY OF THE INVENTION

For many graphics operations optimal performance is achieved by storing an entire 32-bit pixel in a single RAM chip. These operations may be Z-buffering, blending, and raster operations using an XOR function. When displaying video data from a frame buffer, pixels must be read out serially from the frame buffer at real-time speeds. The problem to be solved is how to get 32-bit pixels out of a frame buffer RAM chip with the fewest pins. Pins add cost, so limiting pins provides a lower cost solution.

As noted above, VRAM or FBRAM frame buffers add a separate video data port so that the main pixel port remains free for rendering. The number of pins used for this second port will affect the frame buffer's RAM, board and digital to analog components cost.

In this connection, according to the present invention, a frame buffer memory with 16 pins for serial video output is used. An entire 32-bit pixel is stored in a single RAM chip. For convenience of notation, the 32-bit pixel is designated as containing four byte (8-bit) quantities: X, B, G and R.

On the first clock cycle, the X and B bytes are made available on the 16 pins of the frame buffer. On the next clock cycle, the G and R bytes are made available. Thus, over two cycles the entire 32-bit pixel is output from the frame buffer.

Another component called a DAC (from digital to analog converter) samples the X and B bytes on 16 input pins. The DAC stores these X and B bytes in an internal register. On the next clock cycle it samples the G and R bytes. The DAC then reassembles the X, B, G and R bytes into a single 32-bit pixel for conversion into video.

With this invention, 32-bit pixels are communicated across a 16-bit pixel data bus. A 16-bit data bus saves a total of 32 pins (16 at the RAM for sending and 16 at the DAC for receiving) over a non-multiplexed 32 bit data bus. The 32 pins saved results in a lower frame buffer cost.

BRIEF DESCRIPTION OF THE DRAWINGS

FIG. 4 is a timing diagram showing 2:1 single buffered interleaved pixel format.

FIG. 5 is a timing diagram showing 2:1 double buffered interleaved pixel format.

FIG. 6 is a timing diagram showing 4:1 single buffered interleaved pixel format.

FIG. 7 is a timing diagram showing 4/2:1 single buffered interleaved pixel format.

FIG. 8 is a timing diagram showing 4/2:1 double buffered interleaved pixel format.

FIG. 9 is a timing diagram showing 8/2:1 single buffered interleaved pixel format.

FIG. 10 is a timing diagram showing timing for the pixel port.

FIG. 11 shows the SC pixel clock input to the pixel port.

FIG. 12 is a timing diagram similar to FIG. 10 showing further detail of pixel port timing.

FIG. 23 illustrates the interleaving format circuits 51 routing table.

DETAILED DESCRIPTION OF THE INVENTION

Figure 1:
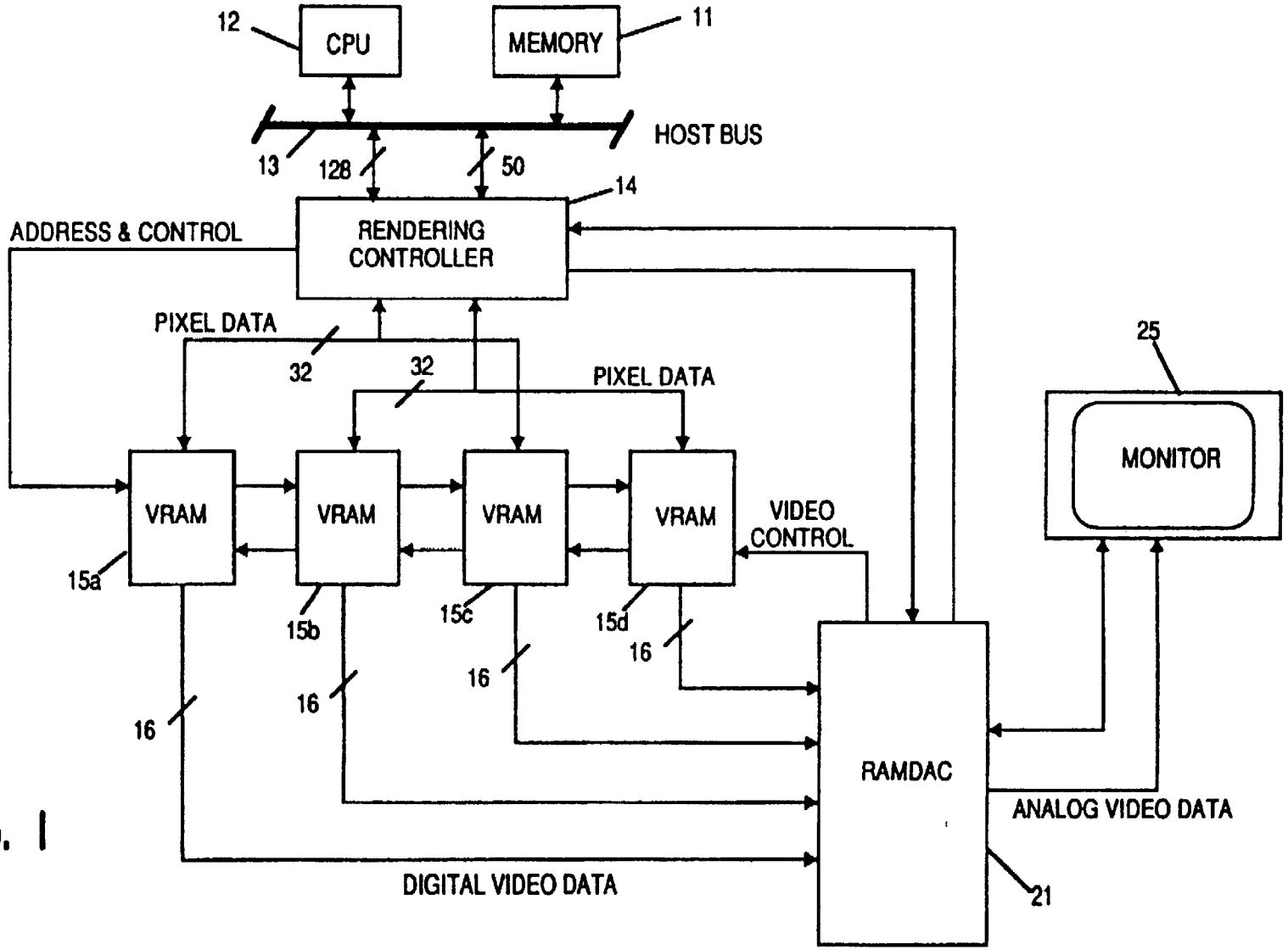
FIG. 1 is a block diagram showing a system having a 64 bit frame buffer memory in which the present invention may be utilized.
Figure 2:
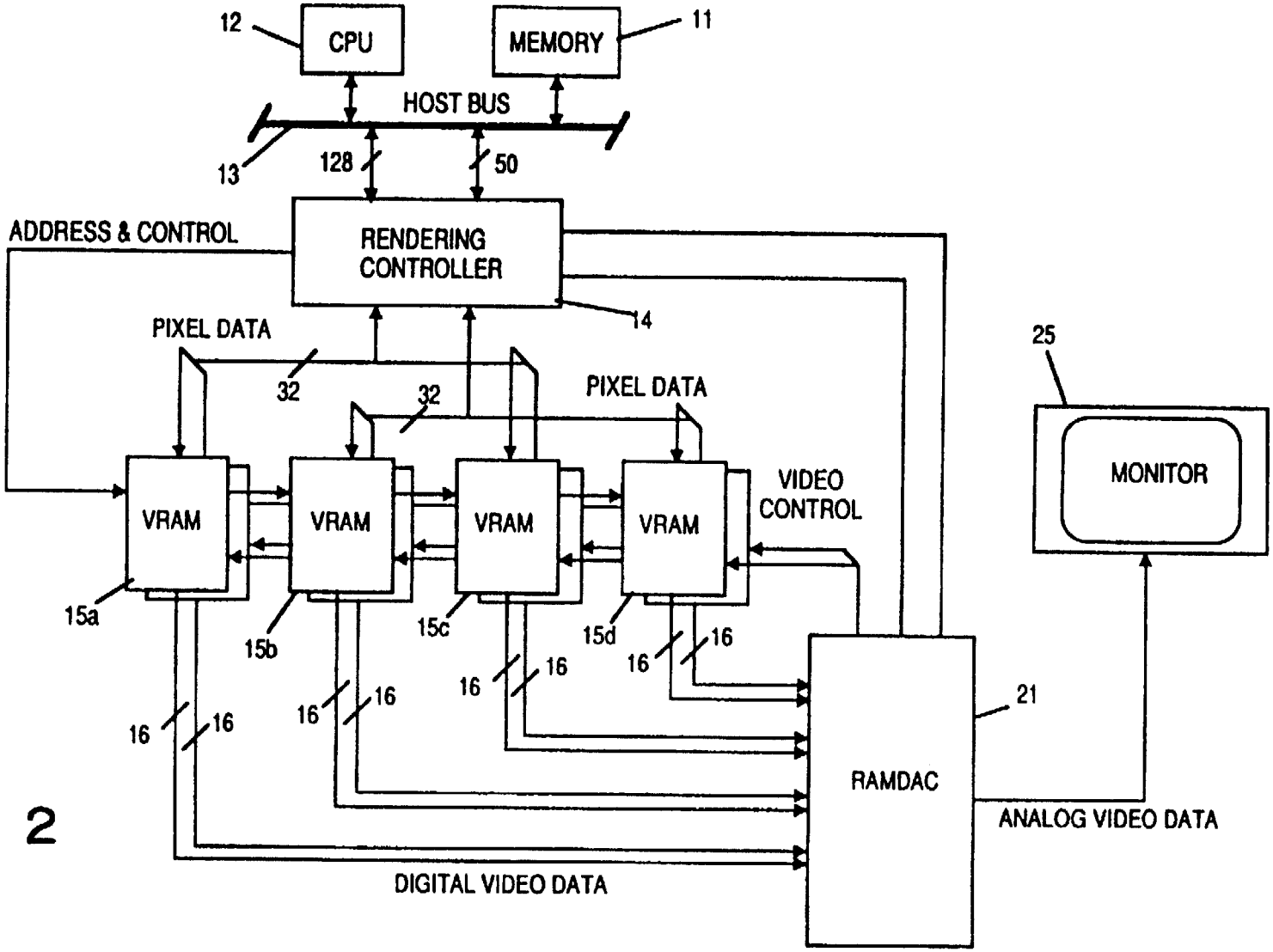
FIG. 2 is a block diagram showing a system having a 128 bit frame buffer memory in which the present invention may be utilized.
Figure 3:
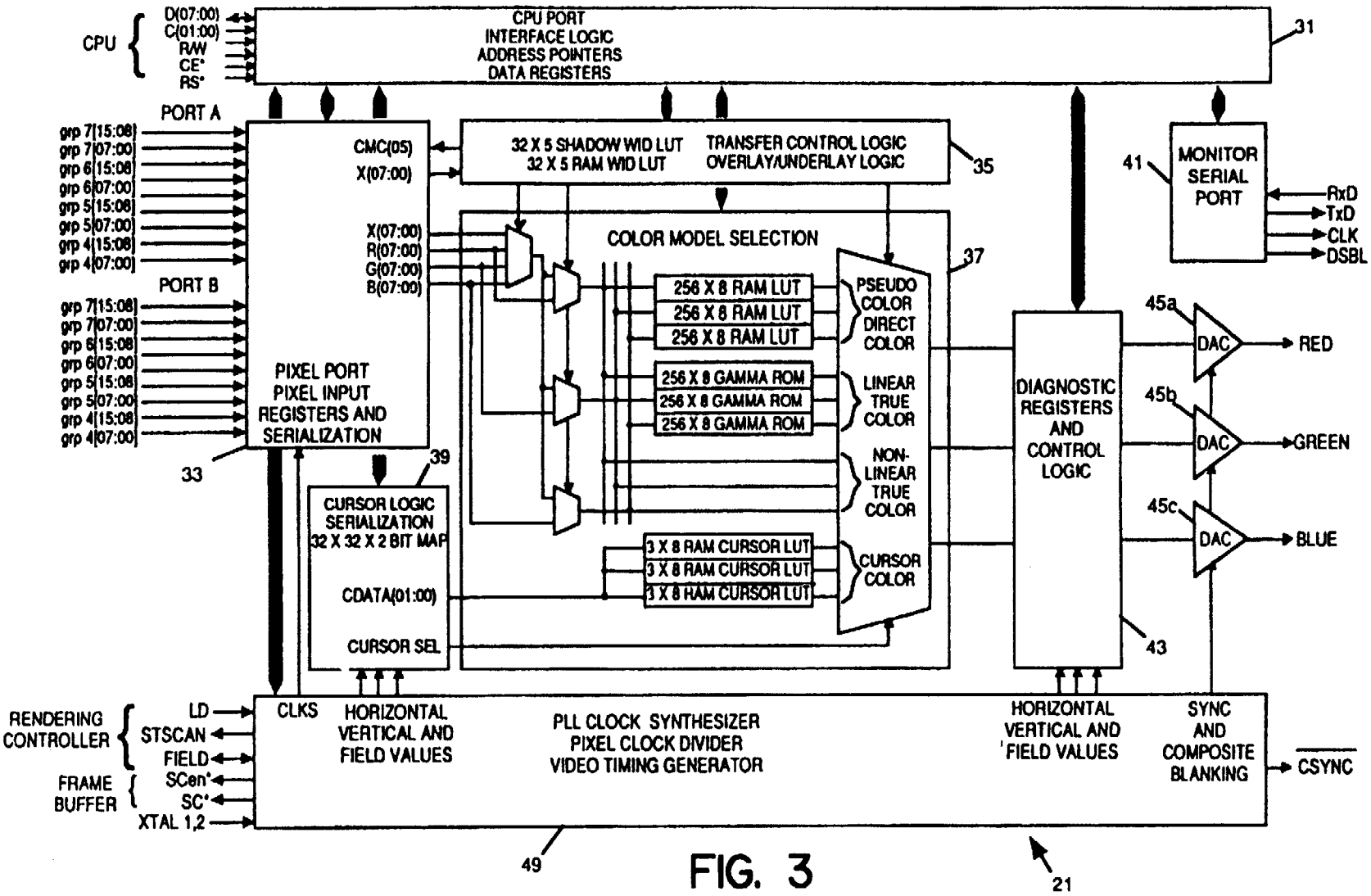
FIG. 3 is a detailed block diagram of a RAMDAC which employs the invented time multiplexing of pixel data hardware.

FIG. 3 shows the components of a RAMDAC 21 which can be utilized to implement the present invention. The RAMDAC includes several functional blocks as follows: CPU port, interface logic, address pointers and data registers 31, pixel port, pixel input registers and serialization 33, shadow and RAM look-up tables, transfer control and overlay/underlay logic 35, color model selection 37, cursor logic serialization 39, monitor serial port 41, diagnostic registers and control logic 43, digital-analog converters (DAC) **45*a*–45*c* and PLL clock synthesizer, pixel clock divider and video timing generator 49. The invention lies mainly in an implementation of the pixel port, pixel input registers and serialization 33 component of the RAMDAC. Therefore, the following description will be limited to the pixel port, pixel input registers and serialization, with information pertaining to the other components of the RAMDAC provided only as needed for an understanding of the present invention. Although the other components shown in FIG. 3 may vary between RAMDACs of different manufacturers, persons skilled in the relevant art will recognize these various components and know how they or their equivalents may be implemented The pixel port is a synchronous input port which accepts interleaved pixel data. Several interleaving formats are required. Selection among these utilizes register programming and is done as part of a boot time configuration process. RAMDAC 21** has two pixel ports, labeled A and B, with a programmable interleaving factor. This configuration accommodates double buffered operation for animation. Here, as in all other cases, the interleaving selection is made during configuration. The selection of port A or port B is made by decoding a window attribute field of port A. In 4:1 and 8/2:1 pixel formats an X field comes from ports A and B. The contents of the X data field are interpreted as either a Window Identification (WID) index or as an Overlay Color. The Overlay Color case and selecting the particular interpretation of the X data field is discussed below.

For the case where the X field is interpreted as a WID, Window ID's (WIDs) are index addresses into a WID look up table which serve to select the pixel source, e.g. port A or B, and to associate the pixel with a particular color model. The X field is a component of every pixel and its content may differ in contiguous pixels. Therefore, port and color model selection must be performed for each individual pixel.

The described interleaving formats are divided into two broad categories. These are the single buffered interleaving format, and the double buffered interleaving format.

In 2:1 and 4/2:1 input formats, the X field from port A is used. The X field from port B is ignored.

In 4:1 and 8/2:1 input formats, the X field from each pixel is used.

The X field does not directly control port and color model selection. The contents of the lower five bits of the X field, X[04:00], constitute the address to the active WID LUT; hereafter called WID[05:00]. It is contained in the locations corresponding to these addresses and is used to effect the port and control color model selection according to definitions shown in Table 1, "Color Model Table Data Entry Codes," below.

TABLE 1

"Color Model Table Data Entry Codes,

| Selected Input Port and Color Model | Color Model Control 5* | 4 | 3 | 2 | 1 | 0 |
|---|---|---|---|---|---|---|
| Input Port B - 24-Bit Non-Linear True Color | 1 | 1 | 1 | 0 | x | x |
| Input Port B - 24-Bit Linear True Color | 1 | 1 | 0 | 1 | x | x |
| Input Port B - 24-Bit Direct Color | 1 | 1 | 0 | 0 | x | x |
| Input Port B - 8-Bit Non-Linear Grey Scale from B Channel | 1 | 0 | 1 | 0 | 1 | 1 |
| Input Port B - 8-Bit Non-Linear Grey Scale from G Channel | 1 | 0 | 1 | 0 | 1 | 0 |
| Input Port B - 8-Bit Non-Linear Grey Scale from R Channel | 1 | 0 | 1 | 0 | 0 | 1 |
| Input Port B - 8-Bit Non-Linear Grey Scale from X Channel (8/2:1 or 4:1 only) | 1 | 0 | 1 | 0 | 0 | 0 |
| Input Port B - 8-Bit Linear Grey Scale from B Channel | 1 | 0 | 0 | 1 | 1 | 1 |
| Input Port B - 8-Bit Linear Grey Scale from G Channel | 1 | 0 | 0 | 1 | 1 | 0 |
| Input Port B - 8-Bit Linear Grey Scale from R Channel | 1 | 0 | 0 | 1 | 0 | 1 |
| Input Port B - 8-Bit Linear Grey Scale from X Channel (8/2:1 or 4:1 only) | 1 | 0 | 0 | 1 | 0 | 0 |
| Input Port B - 8-Bit Pseudo Color from B Channel | 1 | 0 | 0 | 0 | 1 | 1 |
| Input Port B - 8-Bit Pseudo Color from G Channel | 1 | 0 | 0 | 0 | 1 | 0 |
| Input Port B - 8-Bit Pseudo Color from R Channel | 1 | 0 | 0 | 0 | 0 | 1 |
| Input Port B - 8-Bit Pseudo Color from X Channel (8/2:1 or 4:1 only) | 1 | 0 | 0 | 0 | 0 | 0 |
| Input Port A - 24-Bit Non-Linear True Color | 0 | 1 | 1 | 0 | x | x |
| Input Port A - 24-Bit Linear True Color | 0 | 1 | 0 | 1 | x | x |
| Input Port A - 24-Bit Direct Color | 0 | 1 | 0 | 0 | x | x |
| Input Port A - 8-Bit Non-Linear Grey Scale from B Channel | 0 | 0 | 1 | 0 | 1 | 1 |
| Input Port A - 8-Bit Non-Linear Grey Scale from G Channel | 0 | 0 | 1 | 0 | 1 | 0 |
| Input Port A - 8-Bit Non-Linear Grey Scale from R Channel | 0 | 0 | 1 | 0 | 0 | 1 |
| Input Port A - 8-Bit Non-Linear Grey Scale from X Channel | 0 | 0 | 1 | 0 | 0 | 0 |
| Input Port A - 8-Bit Linear Grey Scale from B Channel | 0 | 0 | 0 | 1 | 1 | 1 |
| Input Port A - 8-Bit Linear Grey Scale from G Channel | 0 | 0 | 0 | 1 | 1 | 0 |
| Input Port A - 8-Bit Linear Grey Scale from R Channel | 0 | 0 | 0 | 1 | 0 | 1 |
| Input Port A - 8-Bit Linear Grey Scale from X Channel | 0 | 0 | 0 | 1 | 0 | 0 |
| Input Port A - 8-Bit Pseudo Color from B Channel | 0 | 0 | 0 | 0 | 1 | 1 |
| Input Port A - 8-Bit Pseudo Color from G Channel | 0 | 0 | 0 | 0 | 1 | 0 |
| Input Port A - 8-Bit Pseudo Color from R Channel | 0 | 0 | 0 | 0 | 0 | 1 |
| Input Port A - 8-Bit Pseudo Color from X Channel | 0 | 0 | 0 | 0 | 0 | 0 |

PIXEL DISPLAY ORDERING

In each of the following described formats, pixel data port pin group 0 always has the leftmost pixel as viewed on the screen of all pixels coming in to the pixel port on a clock. Higher-numbered bits in each pixel are the more significant bits of the pixels, i.e. cause a larger change in the DAC output voltage when selected for color palette bypass.

PIXEL PORT SIGNALS

RED, GREEN, BLUE and Window Attribute Field Pixel Inputs

These are the video data and window attribute inputs. To facilitate discussion, assume that the pixel inputs are divided into two ports, labeled A and B which consist of four groups per port. Furthermore, each group is divided into an upper byte and a lower byte. Thus, the pixel port comprises a total of 128 pixel bits contained in groups 0 through 7. Table 2 illustrates these assignments.

TABLE 2

Pixel Port Naming Convention

| Pixel Port | Group | Group Bits | Device Bits |
|---|---|---|---|
| B | | [15:8] | PB(63–56) |
| | 7 | [7:0] | PB(55–48) |
| | | [15:8] | PB(47–40) |
| | 6 | [7:0] | PB(39–32) |
| | | [15:8] | PB(31–24) |
| | 5 | [7:0] | PB(23–16) |
| | | [15:8] | PB(15–08) |
| | 4 | [7:0] | PB(07–00) |
| A | | [15:8] | PA(63–56) |
| | 3 | [7:0] | PA(55–48) |
| | | [15:8] | PA(47–40) |
| | 2 | [[7:0] | PA(39–32) |
| | | [15:8] | PA(31–24) |
| | 1 | [7:0] | PA(23–16) |
| | | [15:8] | PA(15–08) |
| | 0 | [[7:0] | PA(07–00) |

The arrangement of data arriving at the pixel port is hereafter referred to as an interleaving format. RAMDAC 21 accommodates five interleaving formats which are selected by configuration register programming performed at boot time. The five interleaving formats are defined below.

PIXEL FORMATS SUPPORTED

Each of the pixel formats is explained and illustrated in the following sections. It should be noted that the serialized pixel detail is not intended to show a cycle relationship with data coming in. The pixel format is selected by programming the Video Format Control Register. The mapping of this register is shown in Table 3.

TABLE 3

| Bit(s) | Field | Reset Value | Description |
|---|---|---|---|
| 15–4 | Reserved | 0x00 | |
| 3 | Transparent Overlay Enable (0) Disabled (1) Enabled | 0 | When set to a logical zero, the overlay disabled state, the enable bit causes the multiplexer to select the Underlay path, i.e., WID[05:00] are passed to CMC[05;00]. When set to a logical 1, the overlay enabled state, the action of the multiplexer is controlled by the result of the equality comparison. |
| 2 | Double Buffer Enable (0) Single Buffered (1) Double Buffered | 0 | This field is valid only when in the 4/2:1 or 2:1 pixel format. Other formats require that this bit be set to 0. |
| 1,0 | Pixel Format Control (00) 2:1 (01) 4:1 (10) 4/2:1 (11) 8/2:1 | 00 | Selects the pixel interleaving format. The LD frequency for each multiplex rate is: $f_{LD}$ = fp/2 MHz, $f_{LD}$ = fp/4 MHz, $f_{LD}$ = fp/2 MHz, $f_{LD}$ = fp/4 MHz. |

2:1—Single and Double Buffered Interleaving Formats

These formats are applicable when operated at pixel frequency, fp, ≦135 MHz, with a LD frequency, $f_{LD}$=fp/2

MHz. These formats are illustrated in FIGS. 4 and 5. The function of the X field was explained above.

4:1—Single Buffered Interleaving Format

This mode is valid for fp,≦220 MHz. LD frequency. $f_{LD}$=fp/4 MHz. This format is illustrated in FIG. 5.

4/2:1—Single and Double Buffered Interleaving formats

This mode is applicable when operated at pixel frequency, fp, ≦135 MHz. LD frequency, $f_{LD}$=fp/2 MHz.

This format is illustrated in FIG. 6 and FIG. 7.

8/2:1—Single Buffered Interleaving Format

This format is applicable when operated at frequencies fp,≦220 MHz. LD frequency, $f_{LD}$=fp/4 MHz.

This format is illustrated in FIG. 8.

PIXEL PORT TIMING

The design incorporates circuitry to insure correct entry of pixel port data as the phase relationship of LD and pixel clock is varied between certain limits. This circuitry performs the required internal adjustments either during every vertical blanking interval or when invoked by an external mechanism. The mode of operation is controlled by register programming. The timing relationships of SC, LD, pixel clock and pixel data are specified FIGS. 10–12.

Table 4 provides a description of the various signals utilized by the RAMDAC.

TABLE 4

| Signal Name | I/O/Z | Description |
|---|---|---|
| D(7:0) | I/O/Z | CPU Data Bus. Bidirectional data. The CPU port will zero fill unused bits on data reads. |
| C(1:0) | I | CPU Control Bus Input. These signals serve a dual purpose. They define major divisions in the RAMDAC address space and the access type. |
| R/W | I | CPU Read/Write Control Input. Defines the transaction direction. |
| LB* | I | CPU Low Byte Control. |
| CE* | I | CPU Chip Enable Input. When negated, this signal causes the RAMDAC to ignore all CPU interface signals with the exception of reset. |
| P(A,B)(63:0) | I | Pixel Port Inputs. These inputs have internal pullup resistors that cause the logic level to be high if they are left unconnected. |
| LD | I | Pixel Port Load Clock. The rising edge of this signal captures input pixel data. |
| PVLD | I | Pixel Port Data Valid. This input is captured on the rising edge of LD, along with pixel data. |
| SC | O | Serial Clock Output. This signal is produced by the Pixel Clock Divider. It is meant to be used as the clock for the serial port of the video memory. Please refer to the description of the Pixel Clock Divider for details. |
| SCEN | O | Serial Clock Enable Output. This signal is produced by the timing generator and is meant to control the serial port of the video memory. |
| STSCAN | O | Horizontal scan line indicator. This signal is produced by the timing generator and is meant for use by external circuitry for the purpose of indexing the serial port of the video memory. |
| FIELD | I/O | Odd Field Indicator. This signal is produced by the timing generator and is meant for use by external circuitry for the purpose of indexing the serial port of the video memory. |
| XTAL1, XTAL2 | I,O | PLL Reference Crystal. |

TABLE 4-continued

| Signal Name | I/O/Z | Description |
|---|---|---|
| COMP, COMP2 | | Compensation for internal reference amplifier. |
| CSYNC* | O | Composite Sync Output. |
| MON(3:0) | I | Monitor Serial Port Data |
| RESET* | I | Reset Input. This is the Reset signal. Its' assertion causes a number of actions, these are described in following paragraphs. |

Figure 13:
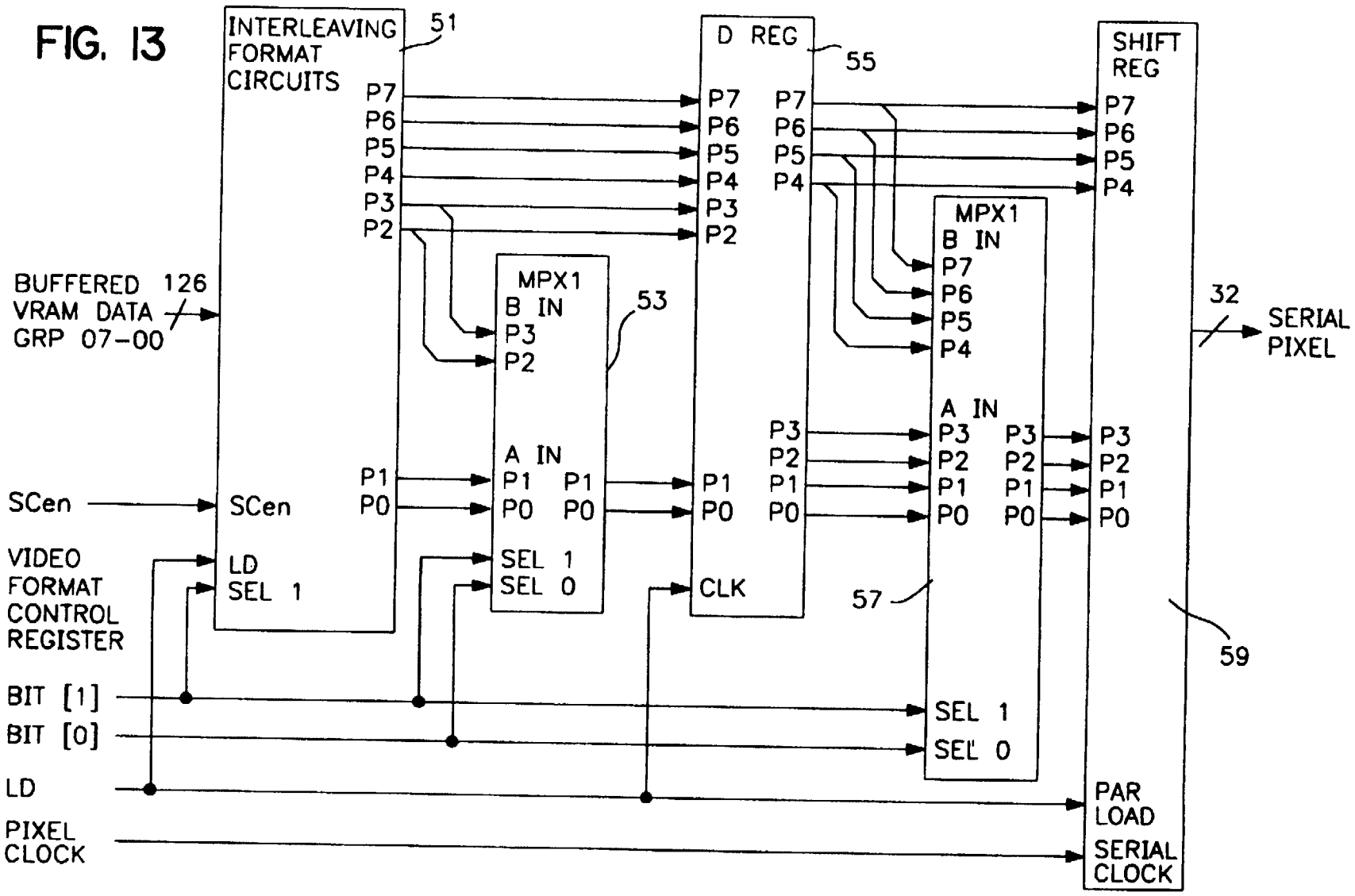
FIG. 13 is a circuit diagram of an implemenation of the pixel port input registers and serialization according to the present invention.
Figure 14:
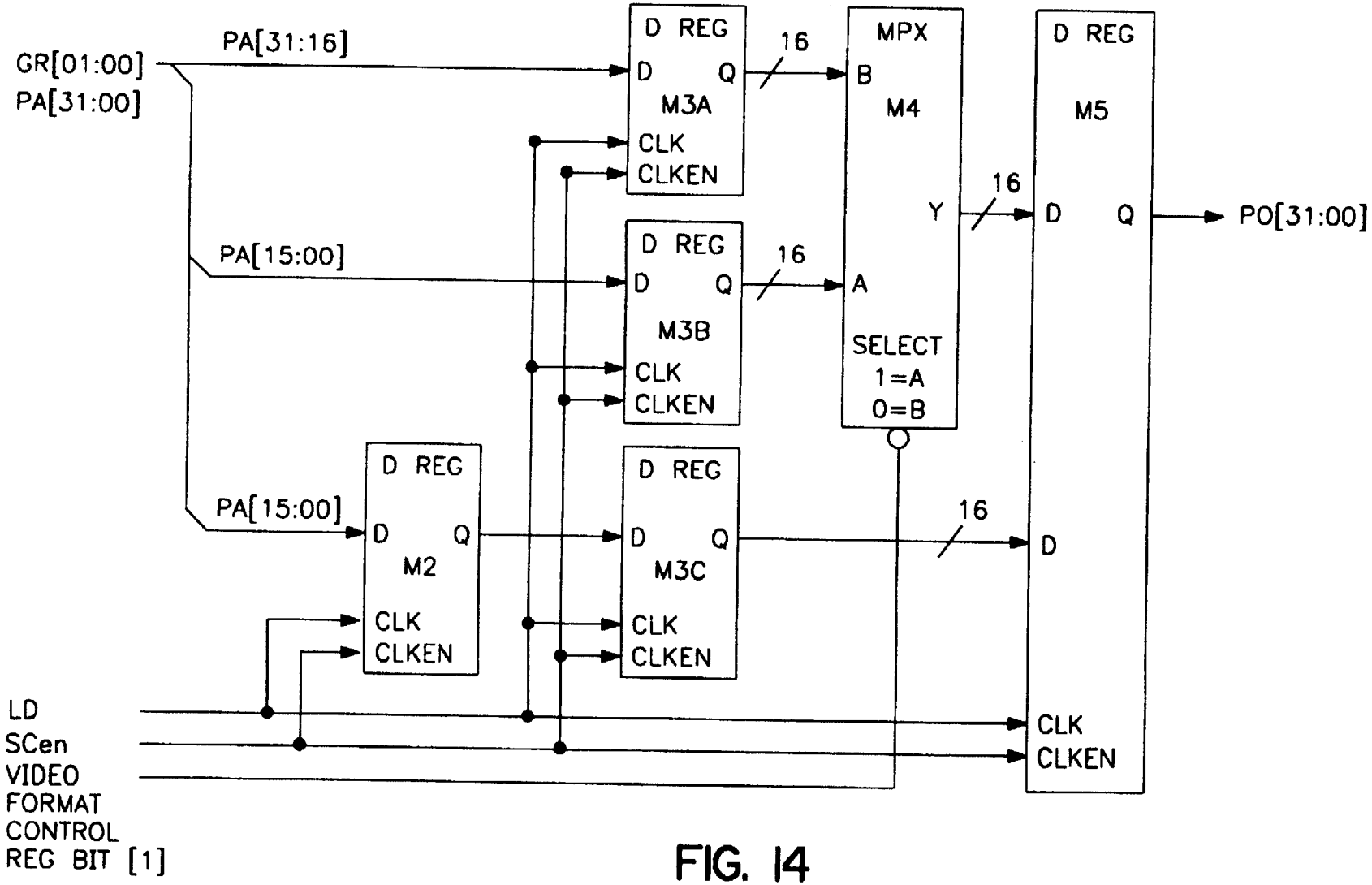
FIG. 14 shows a pixel port interleaving format circuit for pixel 0.
Figure 15:
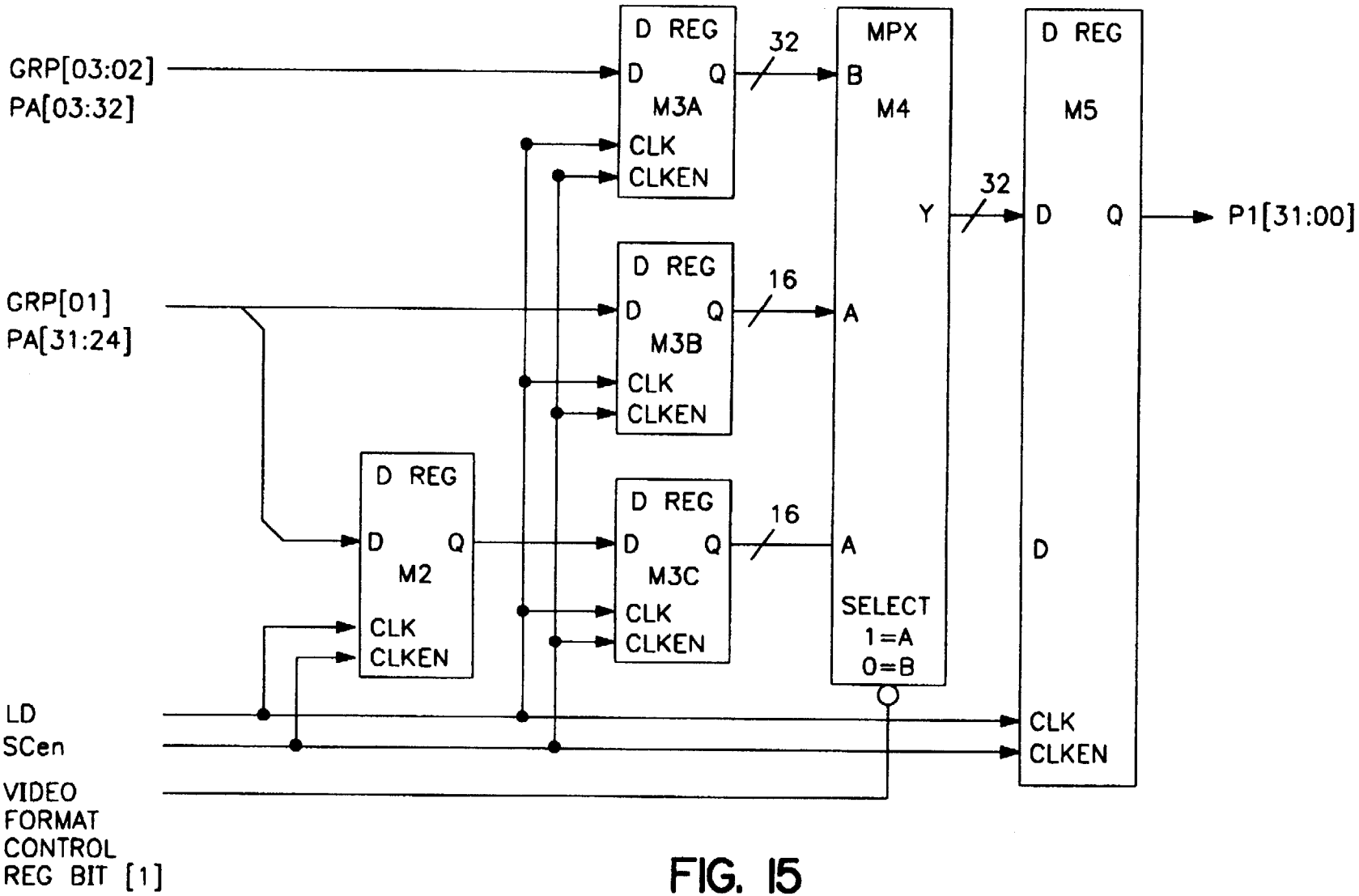
FIG. 15 shows a pixel port interleaving format circuit for pixel 1.
Figure 16:
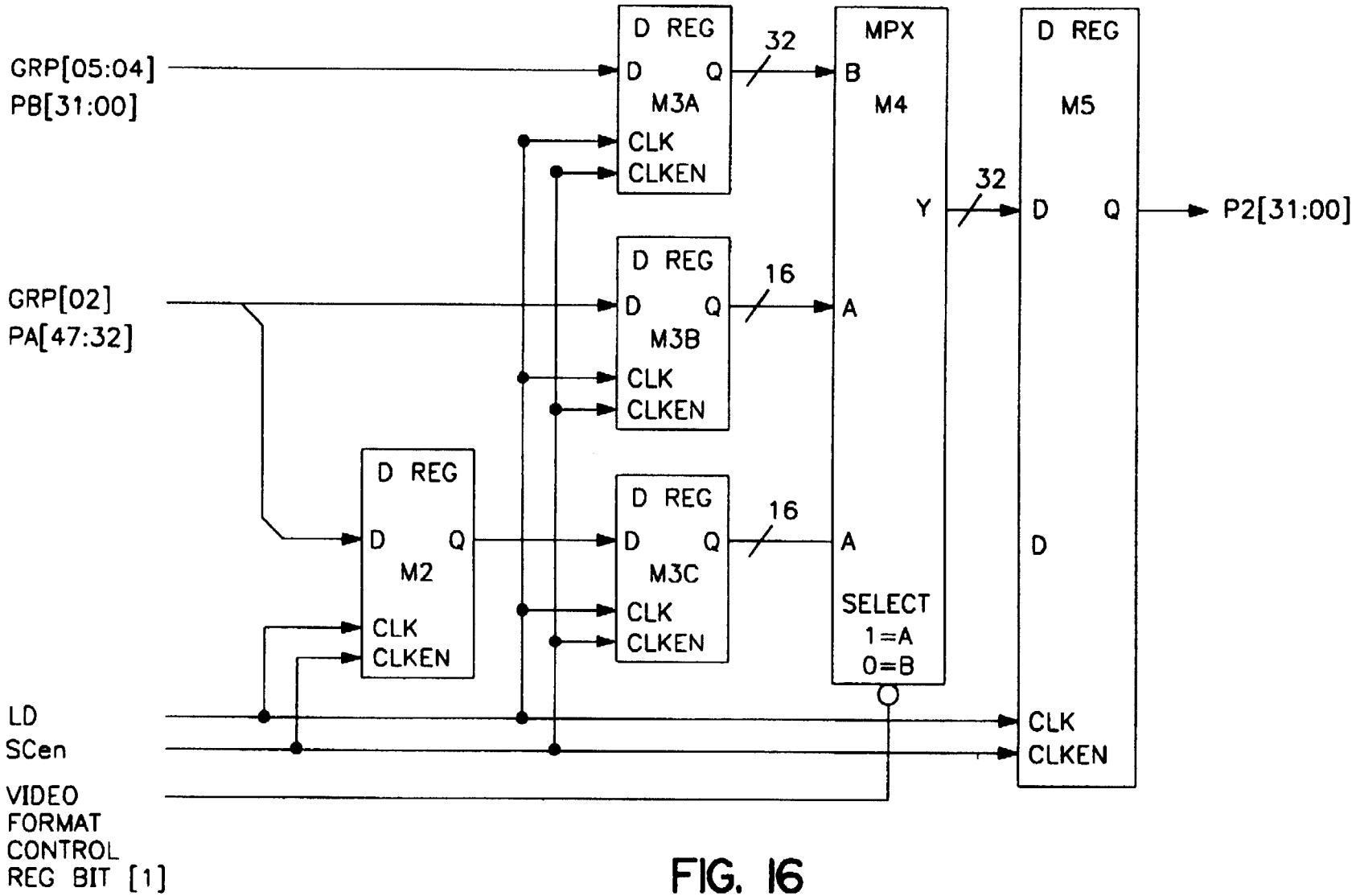
FIG. 16 shows a pixel port interleaving format circuit for pixel 2.
Figure 17:
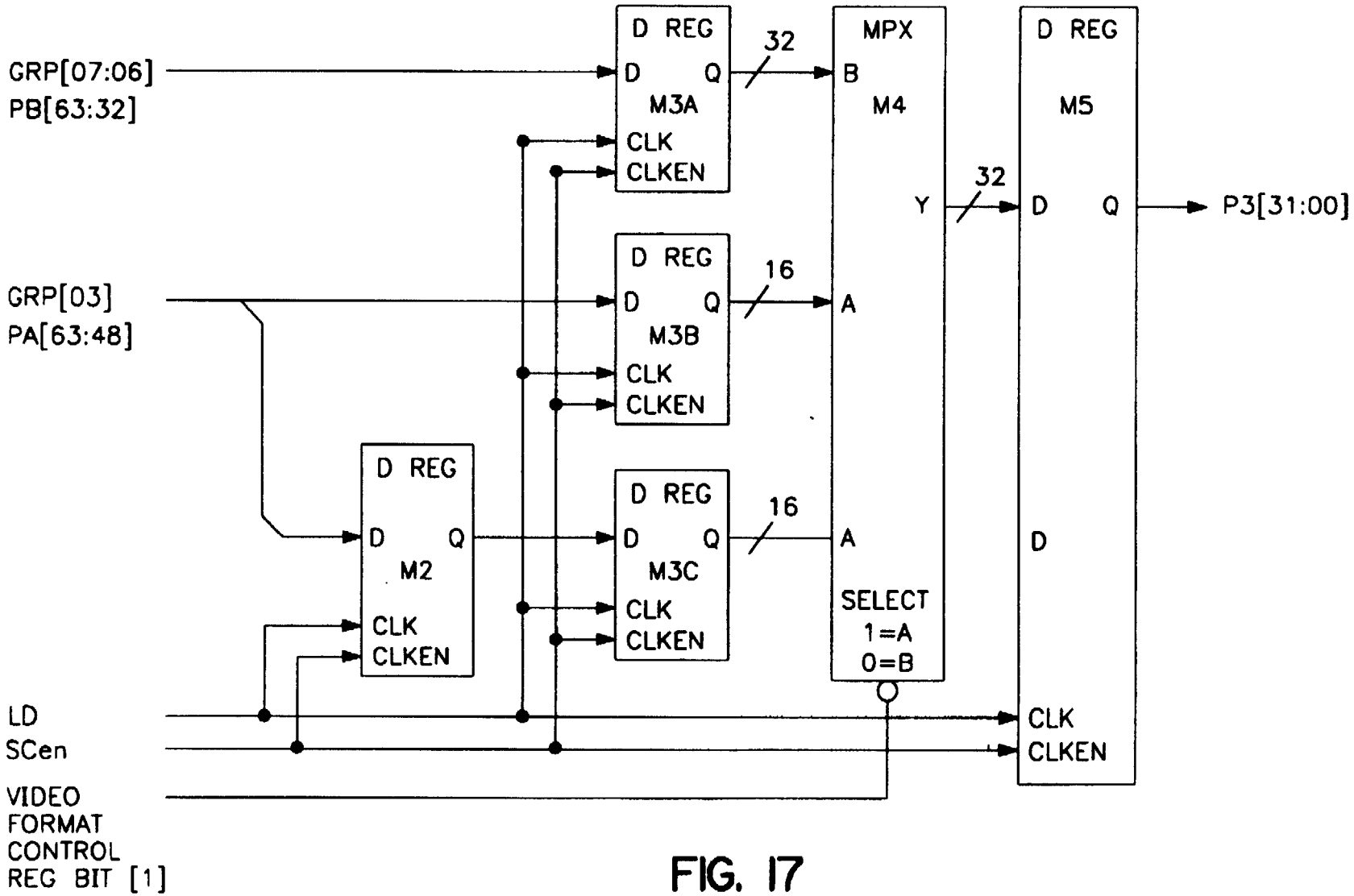
FIG. 17 shows a pixel port interleaving format circuit for pixel 3.
Figure 18:
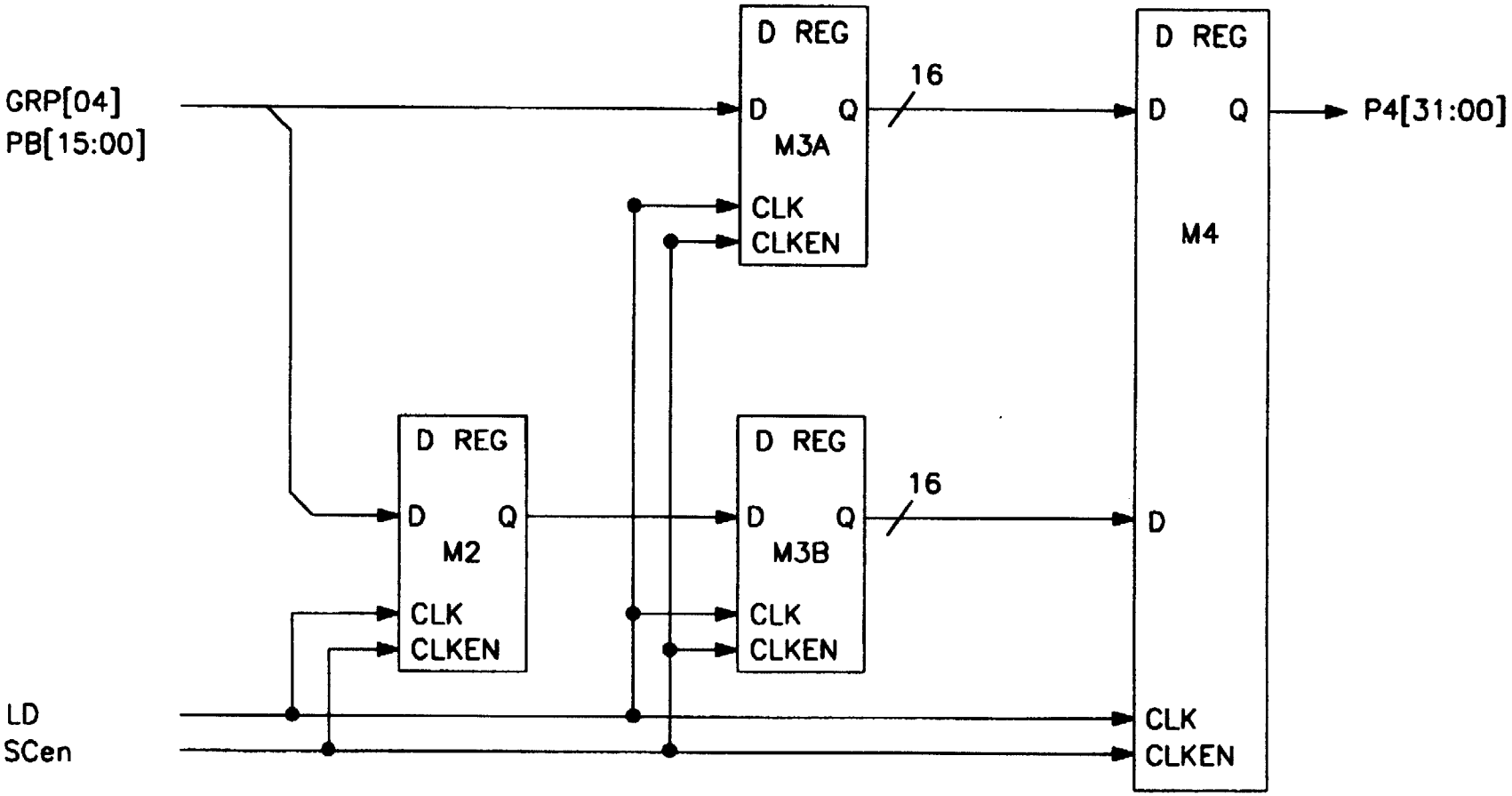
FIG. 18 shows a pixel port interleaving format circuit for pixel 4.
Figure 19:
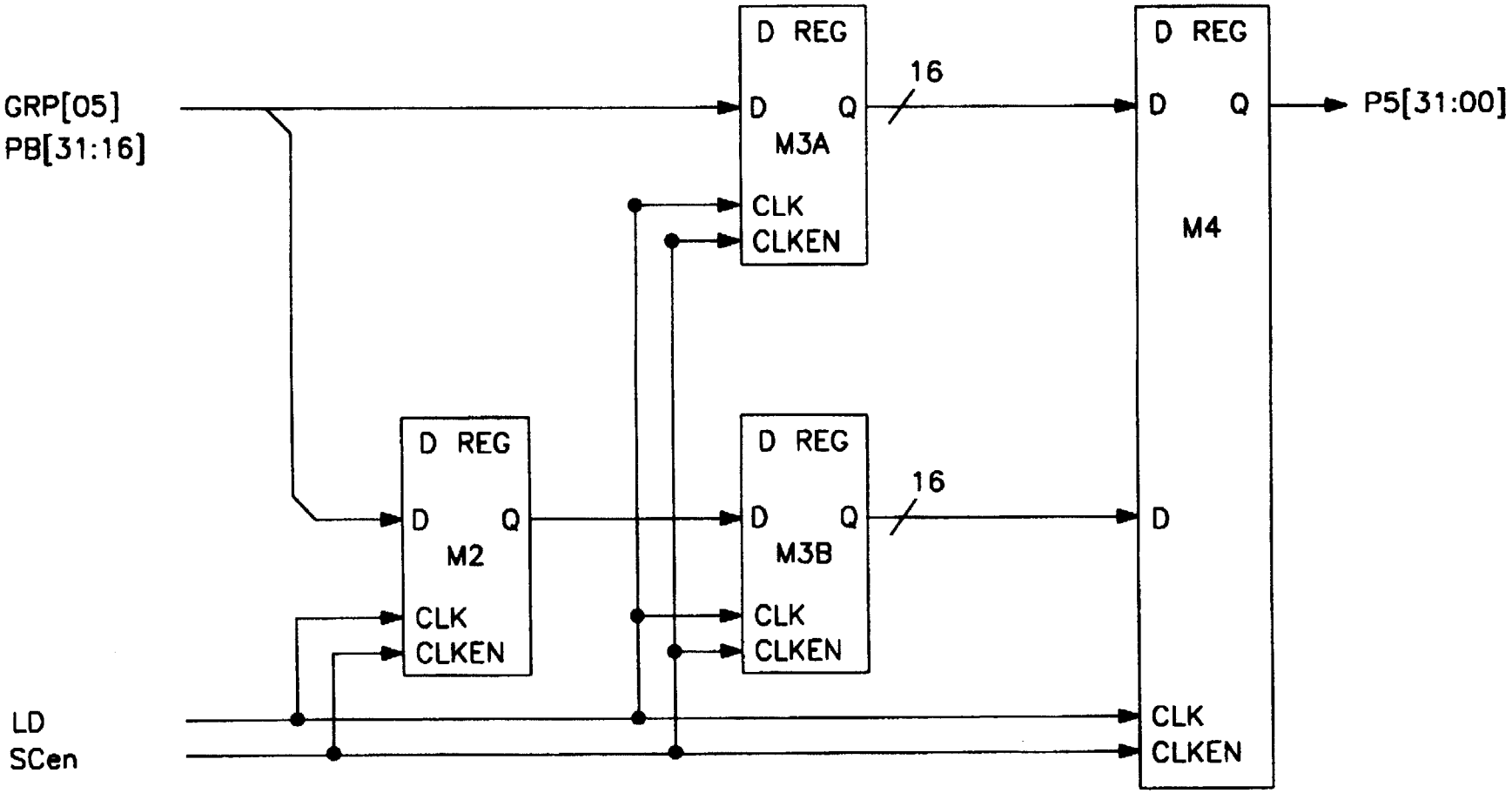
FIG. 19 shows a pixel port interleaving format circuit for pixel 5.
Figure 20:
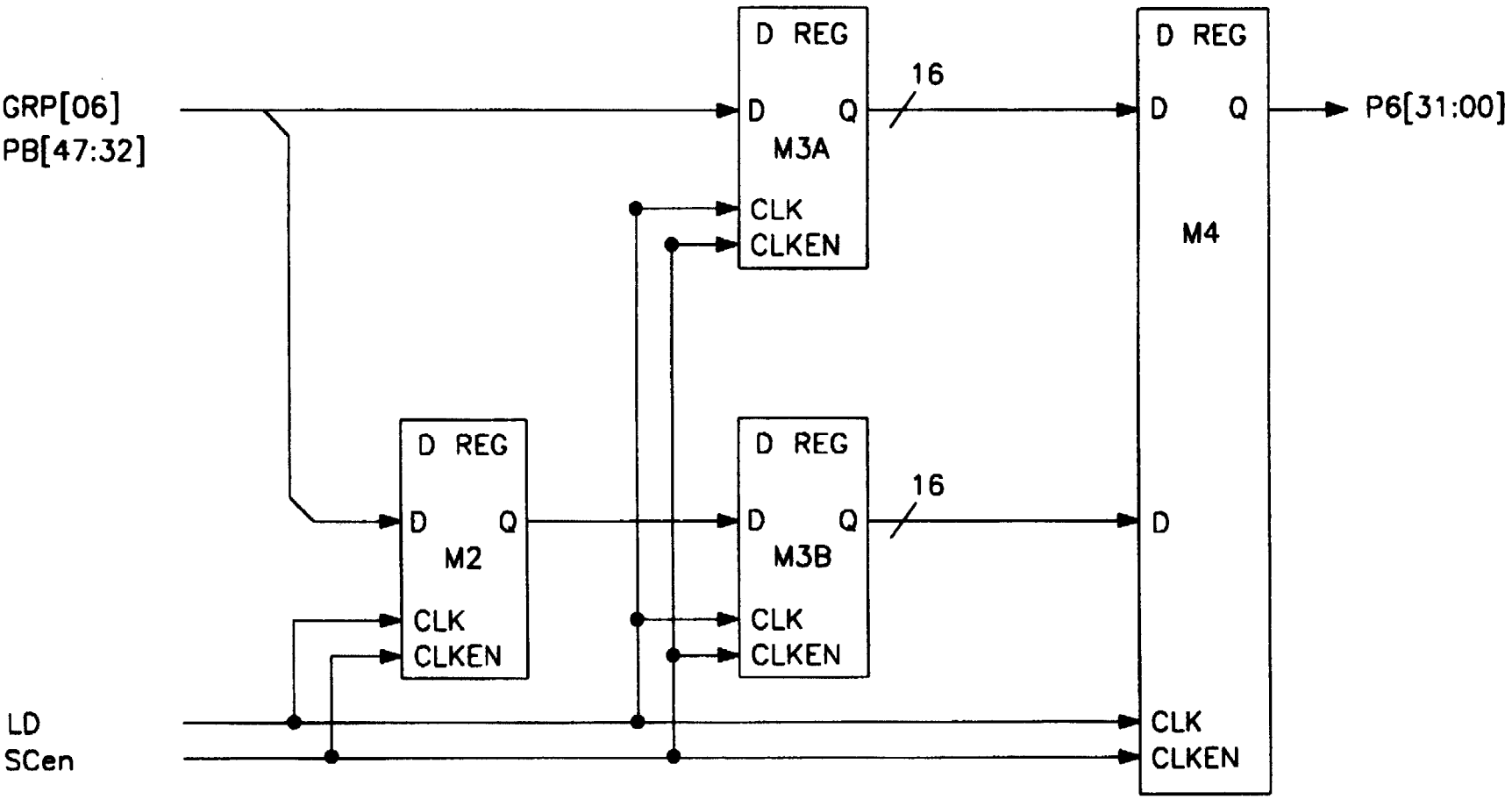
FIG. 20 shows a pixel port interleaving format circuit for pixel 6.
Figure 21:
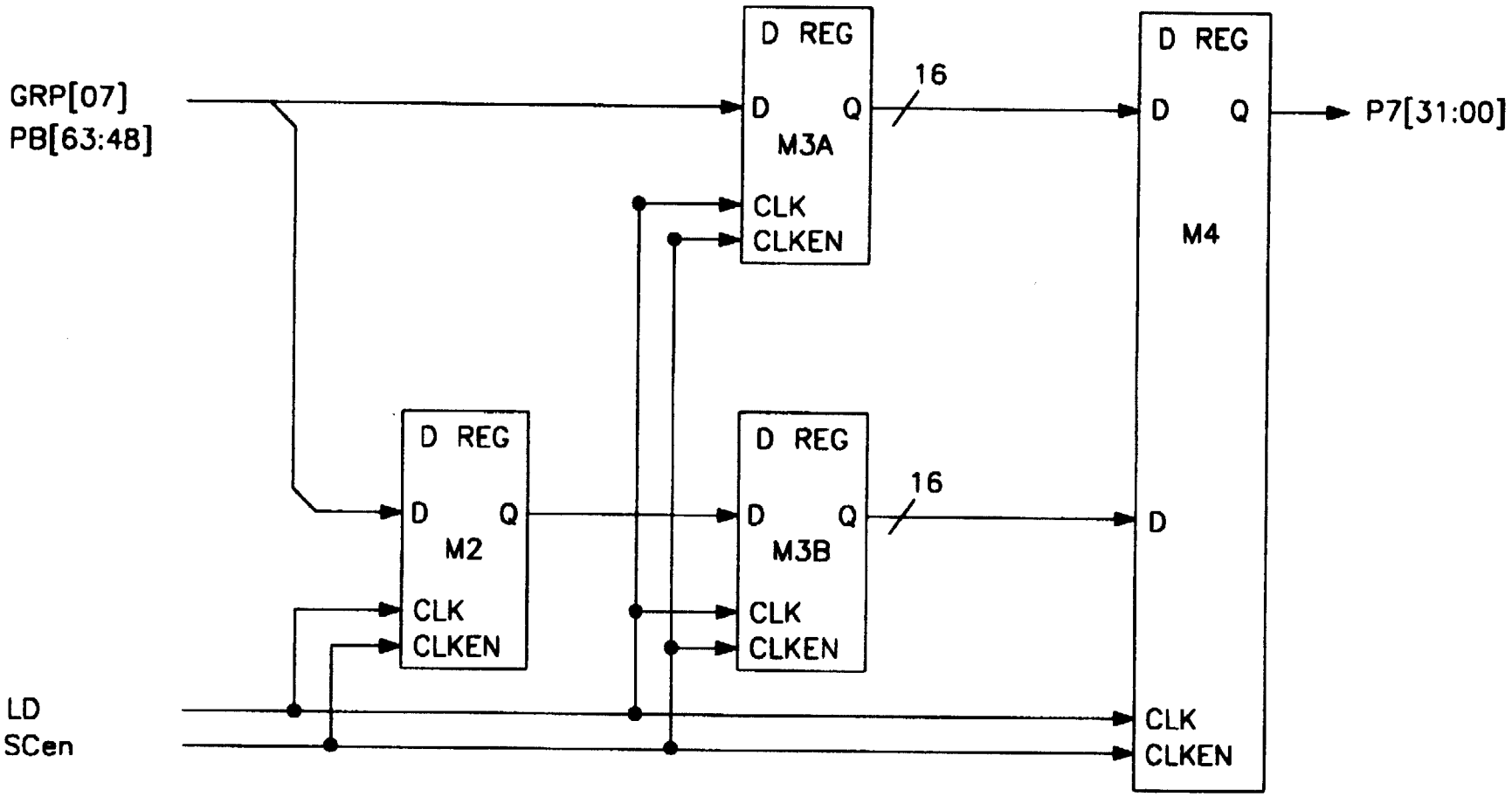
FIG. 21 shows a pixel port interleaving format circuit for pixel 7.

Referring now to FIG. 13, the pixel port of the present invention may be implemented using interleaving format circuits 51, the specifics of which are described with reference to FIGS. 14–21, multiplexor 53 (MPX1), pipeline register 55 (D REG), multiplexor 57 (MPX 2) and shift register 59 (SHIFT REG).

FIG. 13 depicts the flow of signals and elements involved in converting video pixels provided in parallel into a serial stream of single pixels. Here, the various interleaving formats are accommodated and the selection of display buffer, in double buffer modes, is made.

Pixels are received from interleaving format circuits block 51 from the frame buffer memory, in several allowed parallel formats. These formats are described in FIGS. 4–9. The interleaving format circuits block 51 performs the task of undoing the interleaving and providing complete, 32 bit pixels at its output.

Figure 22:
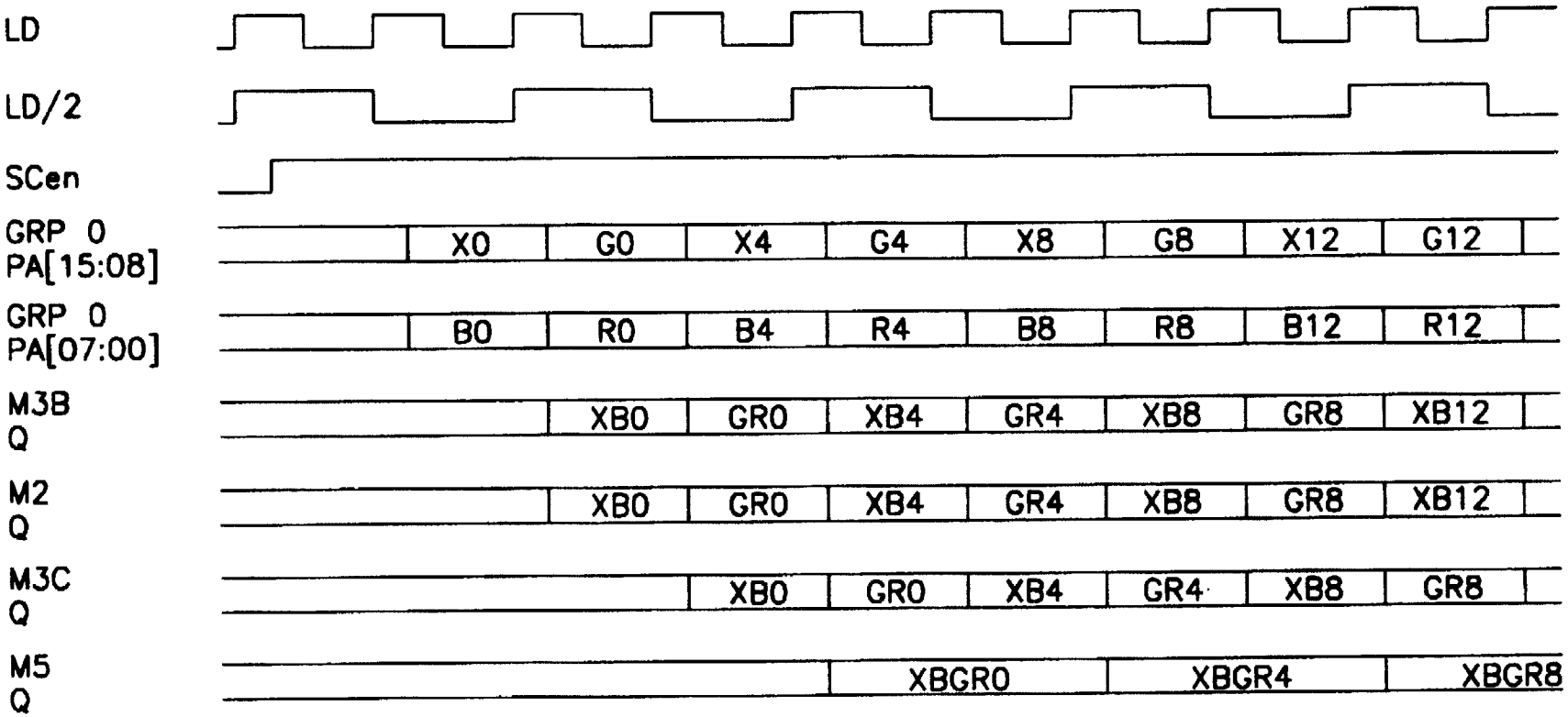
FIG. 22 is a circuit timing diagram for the pixel port for pixel 0.

The interleaving format circuits block utilizes eight subblocks, each one manipulating incoming data to assemble one pixel. The circuits comprising these blocks are illustrated in FIGS. 14–21 for pixels 0–7 respectively. Note that these circuits are not identical but that they do have elements in common. These elements are flip-flop M2, flip-flop M3B and flip-flop M3C in the diagrams for pixels 0–3 and flip-flops M2, M3A and M3B in the diagrams for pixels 4-seven (the mnemonics differ but the functions are identical). These elements deal with the time multiplexed interleaving formats 4/2:1 and 8/2:1. FIG. 22 depicts the action of the pixel 0 circuit in the 4/2:1 case, which is identical to the remaining cases in every respect except the period of LD and LD/2. FIG. 22 shows the manner in which a complete 32 bit pixel is assembled from two LD clock cycles each containing half of the pixel information. When either the 4/2:1 or 8/2:1 interleaving format is selected, bit 1 of the video format control register is set to logic 1. This level causes multiplexer M4 to pass the output of flip-flip M3B to shift register M5; this is the lower half of a pixel and comprises the GREEN and RED components of the pixel. The output of flip-flop M3C also connects to shift register MS. This connection conveys the upper half of the pixel, comprising the X and BLUE components of the pixel. The manner in which pixel 0 is assembled in the 2:1 and 4:1 interleaving formats is not described in the timing diagram. This subject is discussed in subsequent paragraphs.

As previously notedm the format circuits differ. They do so as an artifact of the design which utilizes simple circuitry to implement a seemingly complex task. That task is the reorganization of the incoming data, not only to satisfy the time multiplexing requirement, but also to accommodate single and double buffered operation as well as modes which are not time multiplexed. All of this is accomplished by routing the various groups of incoming pixels to the appropriate interleaving format circuit. This routing is depicted in FIG. 23.

Returning to FIG. 13, portions of the output of the interleaving format circuits are passed to two blocks. The first of these, titled D REG 55, is nothing more than a pipeline register. It accepts P0 through P7 from the interleaving format circuits. The second block multiplexor 53 is titled MPX 1. It accepts P0 through P3. Multiplexor MPX 1 is used to select the appropriate buffer when the system is operated in 2:1 double buffered mode. The multiplexer is controlled by bits 1 and 0 of the video format control register as well as bit number 5 of the of the X components of P0 and P1. Not shown in the diagram is the connection to bit 2 of the user control register which enables or disables the double buffered mode. The combined action of these signals is as follows. If the double buffered mode is enable, (user control register) and if the 2:1 mode has been selected (video format control register) and bit 5 of the X component of P0 (for example) is 1 then the multiplexer passes P2, which is P0 of buffer B. If bit 5 were 0 instead of 1 than the multiplexer would pass P0 from buffer A. If the double buffered mode is not selected, or if the 2:1 mode is not selected, the multiplexer passes P0 and P1.

The output of the pipeline register, D REG, is treated in a manner similar to that described in the previous paragraph. However, in this instance, multiplexor MPX 2 deals with the 4½:1 double buffered mode. The control of this multiplexer is similar to that described, however it is the 4½:1 mode (from the video format control register) which forms part of the qualifier instead of the 2:1 mode.

The final element of the circuit is the shift register which receives P0 through P7 in parallel and produces a serial output consisting of one 32 bit pixel per pixel clock, starting with the location occupied by P0 in the illustration. That is the device shifts in the direction of the lowest numbered pixel occupying the register. Although the register is shown to have eight levels, it does not always shift eight pixels. Indeed, eight pixels are only shifted in the 8½:1 mode. Four pixels are shifted in the 4:1, 4½: (single and double buffered) and two pixels are shifted in the 2:1 mode. This variation in depth is not accomplished by special control circuitry but rather by the nature of the PAR(ALLEL) LOAD clock driven by LD/n. The circuit which produces LD/n is not shown but its operation is described as follows. The state of bits 1 and 0 of the video format control register control a divider which acts to divide the input, LD, by two when in 8½:1 mode or 4½:1 mode. When in 2:1 or 4:1 mode, LD is not altered but is simply passed to the output LD/n. The effect of this circuit is to make the period of its output LD/n equal to the period occupied by m pixels, where m is equal to the interleaving factor.

We claim:

1. An apparatus for multiplexing pixel data from a frame buffer for use by a RAMDAC for display on a display device comprising:

a) interleaving format circuits for coupling to a frame buffer and receiving interleaved pixel data having the form n/m:1, where n is a number of whole pixels being transmitted and m is a fraction of the data which forms a whole pixel which is transmitted during a single clock cycle, where n>m>1;

b) logic circuits coupled to the interleaving format circuits for processing predetermined portions of the received interleaved pixel data to produce serialized pixel data for processing by said RAMDAC, wherein said interleaving format circuits include circuits which undo the interleaving performed by said frame buffer and assemble said pixel data as received from said frame buffer into corresponding sets of pixel data.

2. The apparatus defined by claim 1 wherein said undoing and assembling circuits comprises sets of registers and multiplexors which are coupled together to form a plurality of sub-blocks which cooperatively operate so that each produces a complete pixel formed by a predetermined number of bits.

3. The apparatus defined by claim 2 wherein predetermined ones of said sub-blocks receive signals which define the interleaving format performed by said frame buffer.

4. The apparatus defined by claim 1 wherein the interleaved pixel data is in one of:

4½:1 single buffered interleaving format;

4½:1 double buffered interleaving format;

8½:1 single buffered interleaving format.

5. The apparatus defined by claim 2 wherein said received pixel data comprises 128 pixel bits divided into two sets containing 64 bits each, the bits in said first set being designated PA(63:00), the bits in said second set being designated PB(63:00), wherein one of said sub-blocks comprises:

a first register which receives bits PA(15:00) of said pixel data;

a second register which receives bits PA(31:16) of said pixel data;

a third register which receives bits PA(15:00) of said pixel data;

a fourth register coupled to said first register;

a multiplexor coupled to said second and third registers;

a fifth register coupled to said fourth register and said multiplexor.

6. The apparatus defined by claim 2 wherein said received pixel data comprises 128 pixel bits divided into two sets containing 64 bits each, the bits in said first set being designated PA(63:00), the bits in said second set being designated PB(63:00), wherein one of said sub-blocks comprises:

a first register which receives bits PA(31:24) of said pixel data;

a second register which receives bits PA(63:32) of said pixel data;

a third register which receives bits PA(31:24) of said pixel data;

a fourth register coupled to said first register;

a multiplexor coupled to said second, third and fourth registers;

a fifth register coupled to said multiplexor.

7. The apparatus defined by claim 2 wherein said received pixel data comprises 128 pixel bits divided into two sets containing 64 bits each, the bits in said first set being designated PA(63:00), the bits in said second set being designated PB(63:00), wherein one of said sub-blocks comprises:

a first register which receives bits PA(47:32) of said pixel data;

a second register which receives bits PB(31:00) of said pixel data;

a third register which receives bits PA(47:32) of said pixel data;

a fourth register coupled to said first register;

a multiplexor coupled to said second, third and fourth registers;

a fifth register coupled to said multiplexor.

8. The apparatus defined by claim 2 wherein said received pixel data comprises 128 pixel bits divided into two sets containing 64 bits each, the bits in said first set being designated PA(63:00), the bits in said second set being designated PB(63:00), wherein one of said sub-blocks comprises:

a first register which receives bits PA(63:48) of said pixel data;

a second register which receives bits PB(63:32) of said pixel data;

a third register which receives bits PA(63:48) of said pixel data;

a fourth register coupled to said first register;

a multiplexor coupled to said second, third and fourth registers;

a fifth register coupled to said multiplexor.

9. The apparatus defined by claim 2 wherein said received pixel data comprises 128 pixel bits divided into two sets containing 64 bits each, the bits in said first set being designated PA(63:00), the bits in said second set being designated PB(63:00), wherein one of said sub-blocks comprises:

a first register which receives bits PB(15:00) of said pixel data;

a second register which receives bits PB(15:00) of said pixel data;

a third register coupled to said first register;

a fourth register coupled to said second register and said third register.

10. The apparatus defined by claim 2 wherein said received pixel data comprises 128 pixel bits divided into two sets containing 64 bits each, the bits in said first set being designated PA(63:00), the bits in said second set being designated PB(63:00), wherein one of said sub-blocks comprises:

a first register which receives bits PB(31:16) of said pixel data;

a second register which receives bits PB(31:16) of said pixel data;

a third register coupled to said first register;

a fourth register coupled to said second register and said third register.

11. The apparatus defined by claim 2 wherein said received pixel data comprises 128 pixel bits divided into two sets containing 64 bits each, the bits in said first set being designated PA(63:00), the bits in said second set being designated PB(63:00), wherein one of said sub-blocks comprises:

a first register which receives bits PB(47:32) of said pixel data;

a second register which receives bits PB(47:32) of said pixel data;

a third register coupled to said first register;

a fourth register coupled to said second register and said third register.

12. The apparatus defined by claim 2 wherein said received pixel data comprises 128 pixel bits divided into two sets containing 64 bits each, the bits in said first set being designated PA(63:00), the bits in said second set being designated PB(63:00), wherein one of said sub-blocks comprises:

a first register which receives bits PB(63:48) of said pixel data;

a second register which receives bits PB(63:48) of said pixel data;

a third register coupled to said first register;

a fourth register coupled to said second register and said third register.

13. The apparatus defined by claim 1 wherein said processing logic circuits comprise:

a first multiplexor coupled to said interleaving format circuits;

a pipeline register coupled to said first multiplexor and said interleaving format circuits;

a second multiplexor coupled to pipeline register;

a shift register coupled to said pipeline register and said second multiplexor. register is coupled to pipeline register so that fifth through eighth sets of pixel data input to said shift register are fifth through eighth sets of pixel data output from said pipeline register.

14. The apparatus defined by claim 13 wherein said interleaving format circuits assemble said pixel data as received from said frame buffer into corresponding sets of pixel data and said first multiplexor is coupled to said interleaving format circuits so that a first set of said pixel data is a first selectable input to said first multiplexor; a second set of said pixel data is a second selectable input to said first multiplexor; a third set of said pixel data is a third selectable input to said first multiplexor; and a fourth set of said pixel data is a fourth selectable input to said first multiplexor.

15. The apparatus defined by claim 14 wherein said pipeline register is coupled to said first multiplexor to receive first and second selected outputs from said first multiplexor as first and second inputs and is coupled to said interleaving format circuits to receive:

as a third input, said third set of pixel data;

as a fourth input, said fourth set of pixel data;

as a fifth input, a fifth set of pixel data;

as a sixth input, a sixth set of pixel data;

as a seventh input, a seventh set of pixel data;

as an eighth input, an eighth set of pixel data.

16. The apparatus defined by claim 15 wherein said second multiplexor is coupled to said pipeline register to receive as a first selectable input, said first through fourth sets of pixel data output from said pipeline register, and as a second selectable input, said fifth through eighth sets of pixel data output from said pipeline register.

17. The apparatus defined by claim 16 wherein said shift register is coupled to said multiplexor so that first through fourth sets of pixel data input to said shift register are a selected output of said second multiplexor, and said shift register is coupled to pipeline register so that fifth through eighth sets of pixel data input to said shift register are fifth through eighth sets of pixel data output from said pipeline register.

18. A method for multiplexing pixel data from a frame buffer for use by a RAMDAC for display on a display device comprising the steps of:

a) undoing the interleaving performed by said frame buffer and assembling said pixel data as received from said frame buffer into corresponding sets of pixel data, said pixel data having the form n/m:1, where n is a number of whole pixels being transmitted and m is a fraction of the data which forms a whole pixel which is transmitted during a single clock cycle, where n>m>;

b) processing predetermined portions of the received interleaved pixel data to produce serialized pixel data for processing by said RAMDAC, wherein said undoing and assembling produces a plurality of complete pixel sets, each formed by a predetermined number of bits.

19. The method defined by claim 18 wherein said undoing and assembling step produces first through eighth sets of complete pixel data.

20. The method defined by claim 19 wherein said processing step comprises the steps of:

first selecting first and second sets of pixel data from among said first through fourth sets of pixel data;

passing said first and second sets of selected pixel data and said third through eighth sets of pixel data;

second selecting first through fourth sets of said pixel data from among said first through fourth sets of said pixel data on the one hand and from among said fifth through eighth sets of said pixel data on the other hand;

passing said second selected sets of pixel data as first through fourth sets of pixel data and said fifth through eighth sets of pixel data.

* * * * *

UNITED STATES PATENT AND TRADEMARK OFFICE

CERTIFICATE OF CORRECTION

PATENT NO. : 5,696,534
DATED : December 9, 1997
INVENTOR(S) : Lavelle et al.

It is certified that error appears in the above-identified patent and that said Letters Patent is hereby corrected as shown below:

Title page,
*Primary Examiner,* please delete "Richard Hjerfe" and insert -- Richard Hjerpe --.

Column 12,
Lines 11-14, please delete "register is coupled to pipeline register so that fifth through eighth sets of pixel data input to said shift register are fifth through eighth sets of pixel data output from said pipeline register."
Line 61, please delete "n>m>" and insert -- n>m>1 --.

Signed and Sealed this

Twenty-fourth Day of September, 2002

*Attest:*

*Attesting Officer*

JAMES E. ROGAN
*Director of the United States Patent and Trademark Office*